US011912525B2

(12) United States Patent
Kim et al.

(10) Patent No.: US 11,912,525 B2
(45) Date of Patent: Feb. 27, 2024

(54) FINISHER WITH COMPACT MEDIUM CONVEYING STRUCTURE

(71) Applicant: Hewlett-Packard Development Company, L.P., Spring, TX (US)

(72) Inventors: Taehong Kim, Seongnam-si (KR); Wonic Tae, Seongnam-si (KR); Taejin Baek, Seongnam-si (KR); Wonkeun Lee, Seongnam-si (KR); Joonghyun Kim, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/928,080

(22) PCT Filed: Oct. 22, 2020

(86) PCT No.: PCT/US2020/056775

§ 371 (c)(1),
(2) Date: Nov. 28, 2022

(87) PCT Pub. No.: WO2021/242296

PCT Pub. Date: Dec. 2, 2021

(65) Prior Publication Data

US 2023/0219779 A1 Jul. 13, 2023

(30) Foreign Application Priority Data

May 29, 2020 (KR) ..... 10-2020-0064914

(51) Int. Cl.
*B65H 31/30* (2006.01)
*B65H 31/10* (2006.01)
(Continued)

(52) U.S. Cl.
CPC ..... *B65H 31/30* (2013.01); *B65H 31/10* (2013.01); *B65H 31/26* (2013.01); *B65H 31/32* (2013.01);
(Continued)

(58) Field of Classification Search
CPC ..... G03G 21/16; B65H 31/00; B65H 29/38; B65H 37/04; B65H 2405/353
(Continued)

(56) References Cited

U.S. PATENT DOCUMENTS 5,649,695 A 7/1997 Lawrence
7,284,752 B2 * 10/2007 Nagata ..... G03G 15/6541 271/189
(Continued)

FOREIGN PATENT DOCUMENTS

JP 05-039823 A 2/1993
JP 2000-044111 A 2/2000
(Continued)

*Primary Examiner* — Leslie A Nicholson, III
(74) *Attorney, Agent, or Firm* — Brooks, Cameron & Huebsch, PLLC

(57) ABSTRACT

An example finisher includes a first portion extending in a vertical direction, a second portion including an entrance to receive paper as a finishing process target, and a finishing unit to perform a finishing process, the second portion extending from the first portion in a lateral direction, a stacker to receive paper discharged from the finishing unit and which extends in an opposite direction to the second portion based on the first portion, and an elevation driving unit provided on the first portion to elevate the stacker in a vertical direction.

15 Claims, 21 Drawing Sheets

(51) Int. Cl.

| | |
|---|---|
| ***B65H 31/26*** | (2006.01) |
| ***B65H 31/32*** | (2006.01) |
| ***B65H 37/04*** | (2006.01) |
| ***B65H 43/06*** | (2006.01) |

(52) U.S. Cl.
CPC ..... *B65H 37/04* (2013.01); *B65H 43/06* (2013.01); *B65H 2301/4213* (2013.01); *B65H 2403/41* (2013.01); *B65H 2408/121* (2013.01); *B65H 2511/15* (2013.01)

(58) Field of Classification Search
USPC ..... 270/58.13, 58.19, 58.28; 399/110
See application file for complete search history.

(56) References Cited

U.S. PATENT DOCUMENTS

| | | | | |
|---|---|---|---|---|
| 7,571,909 | B2 * | 8/2009 | Saeki | B65H 31/10 271/220 |
| 7,874,552 | B2 | 1/2011 | Chiaki | |
| 7,883,079 | B2 * | 2/2011 | Sato | B65H 45/18 270/32 |
| 7,971,875 | B2 * | 7/2011 | Iino | B62B 3/04 271/213 |
| 8,226,080 | B2 * | 7/2012 | Morita | B65H 31/36 270/58.12 |
| 8,408,531 | B2 * | 4/2013 | Sato | B42B 5/00 270/58.11 |
| 8,424,962 | B2 | 4/2013 | Uehara et al. | |
| 8,672,312 | B2 | 3/2014 | Nonaka | |
| 8,955,838 | B2 * | 2/2015 | Saito | B65H 31/32 271/189 |
| 9,186,926 | B2 | 11/2015 | Nonaka | |
| 9,381,760 | B2 * | 7/2016 | Egawa | B41J 29/02 |
| 10,496,031 | B2 * | 12/2019 | Sugiyama | B65H 31/02 |
| 10,828,925 | B2 * | 11/2020 | Kubo | B65H 31/36 |
| 11,518,641 | B2 * | 12/2022 | Takahashi | B65H 31/24 |
| 2010/0068026 | A1 | 3/2010 | Brewer, III et al. | |
| 2011/0215517 | A1 | 9/2011 | Mizutani et al. | |

FOREIGN PATENT DOCUMENTS

| | | | |
|---|---|---|---|
| JP | 2003-175268 | A | 6/2003 |
| JP | 2004-126157 | A | 4/2004 |
| JP | 2006-206197 | A | 8/2006 |
| JP | 2014-118295 | A | 6/2014 |

* cited by examiner

FINISHER WITH COMPACT MEDIUM CONVEYING STRUCTURE

BACKGROUND

Finishers (i.e., post-processing devices) are devices used to perform a finishing process on a sheet-like printing medium, for example, paper and may be connected to a printing device to form an image forming apparatus. Finishers can perform a finishing process on a printing medium, on which printing has been completed, as a subsequent process of a print job performed in the printing device.

The finishing process may include a bookbinding process for binding multiple sheets of aligned paper, a folding process for folding one or more sheets of paper one or more times, or a punching process for punching holes in one or more sheets of paper.

DETAILED DESCRIPTION

Figure 1:
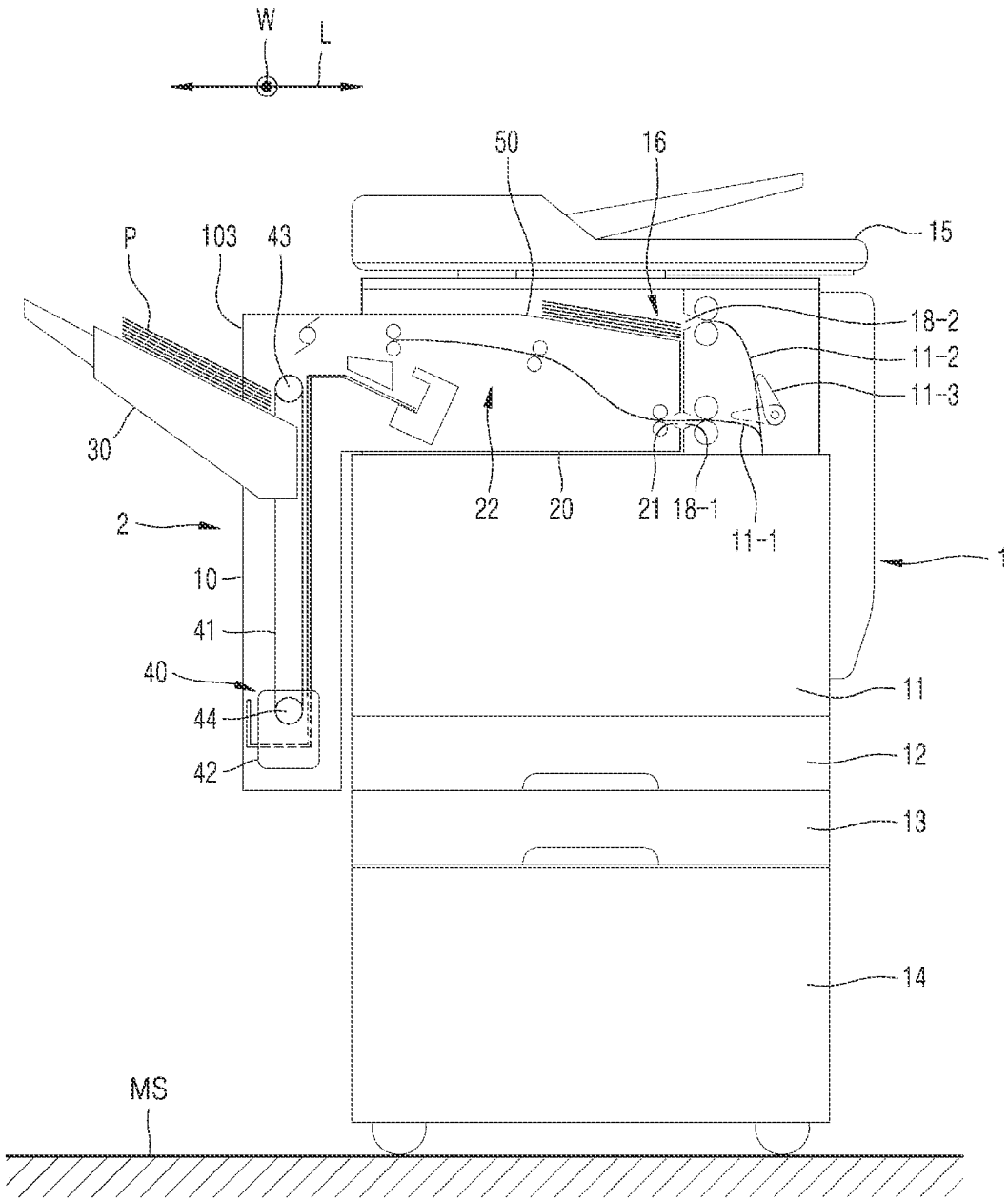
FIG. 1 is a schematic side configuration diagram of a finisher according to an example.

A finisher may be connected to a printing device to perform a finishing process on a sheet-like printing medium, such as paper, that is output from the printing device. A finisher connected, coupled, or combined with a printing device may be classified as a small-capacity finisher or a large-capacity finisher. A concave loading portion, on which discharged paper may be loaded, may be provided in the printing device. A paper discharge port of the printing device may be provided in the concave loading portion. The small-capacity finisher may be installed on the loading portion of the printing device. The large-capacity finisher may have a large size and thus is not able to be installed on the loading portion of the printing device but may be installed at a side of the printing device. In this case, a paper relay module for transporting the paper from the paper discharge port of the printing device to the large-capacity finisher may be used.

In an example, a finishing unit that extends in a lateral direction from a support structure that is extending in a vertical direction and supported at the outside of the printing device may be located within the concave loading portion of the printing device. Further, a stacker, on which paper on which finishing has been completed may be loaded, may extend in an opposite direction to the finishing unit from the support structure and may be located outside the printing device. An elevation driving unit including a motor for elevating the stacker may be provided in the support structure. Thus, a low-cost large-capacity finisher having a compact paper conveying structure that does not require a paper relay module may be implemented. A second stacker, on which paper on which finishing is not performed is loaded, of the paper discharged from the printing device may be provided in the finishing unit.

In an example, adjusting a length of the support structure extending in the vertical direction and supporting the finishing unit is possible. A height of the printing device may vary. Thus, a height of the loading portion in which the finishing unit is installed, may also vary. A height of the support structure may be adjusted so that adjusting of the height of the finishing unit is possible. Thus, a finisher that may be applied to a printing device having various heights may be implemented.

An example finisher may include a support structure extending in the vertical direction and a finishing unit extending from the support structure in the lateral direction. A finisher, in a form in which a finishing unit extends from a support structure in the lateral direction, may fall over due to the weight of the finishing unit in a state in which the finishing unit is not combined, coupled, or connected with the printing device. In an example, a fall-over reduction member may support the finisher to reduce falling over due to the weight of the finisher even when the finisher is not combined, coupled, or connected with the printing device. Thus, handling of the finisher is easy.

Hereinafter, various examples of a finisher will be described with reference to the drawings. Components having the same function are denoted by the same reference numerals, and a redundant description thereof will be omitted.

Figure 2:
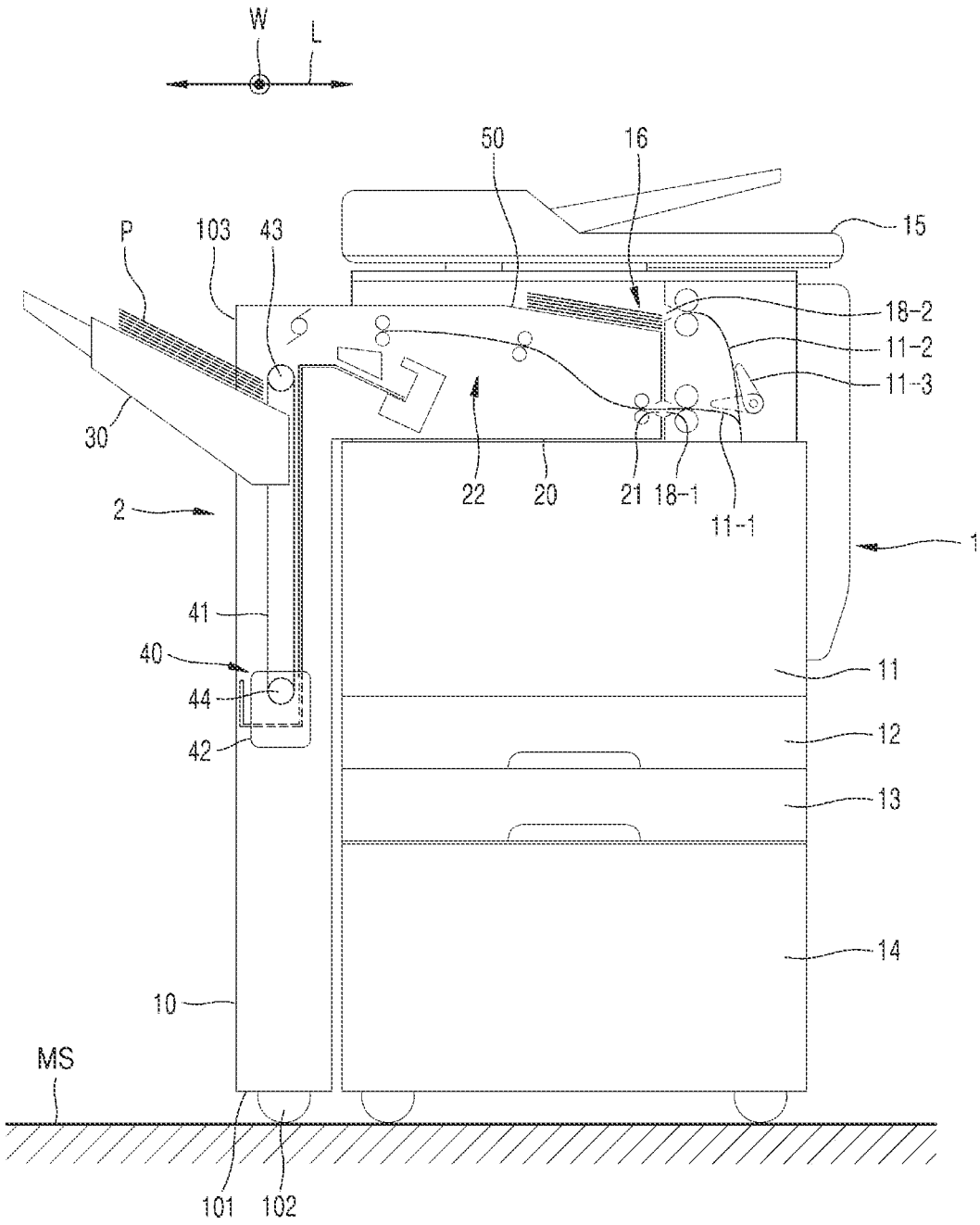
FIG. 2 is a schematic side configuration diagram of a finisher according to an example.
Figure 3:
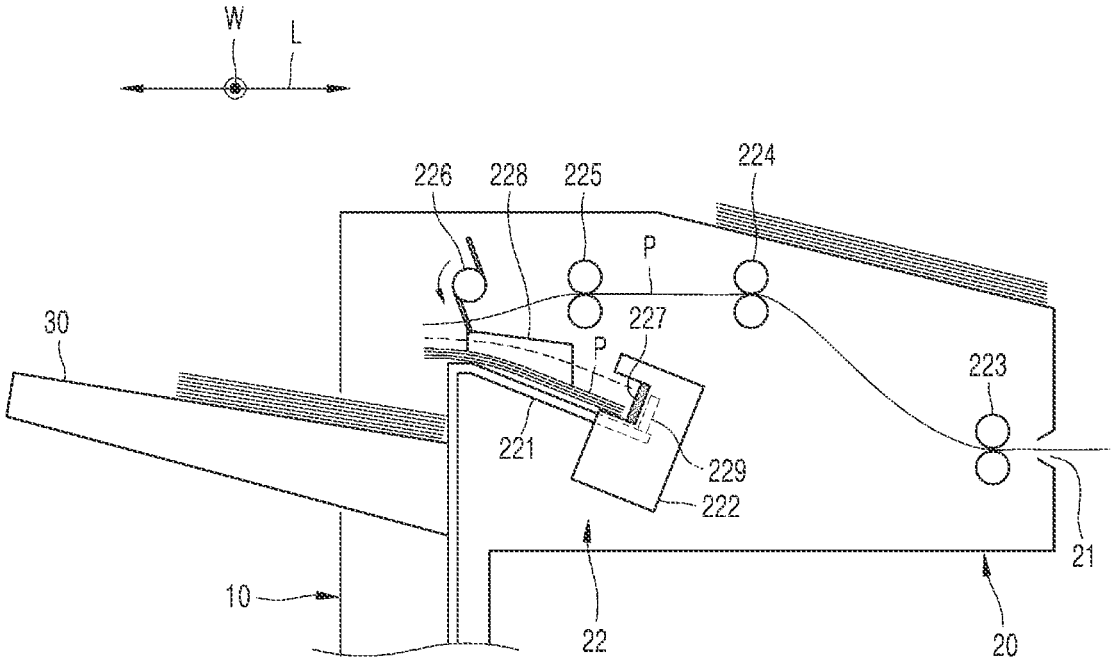
FIG. 3 is a schematic configuration diagram of a finishing unit shown in FIGS. 1 and 2, according to an example.

FIG. 1 is a schematic side configuration diagram of a finisher 2 according to an example. FIG. 2 is a schematic side configuration diagram of the finisher 2 according to an example. FIGS. 1 and 2 show a state in which the finisher 2 is combined with a printing device 1. FIG. 3 is a schematic configuration diagram of a finishing unit 22 shown in FIGS. 1 and 2, according to an example.

Referring to FIGS. 1, 2, and 3, the finisher 2 may include a first portion 10 extending in a vertical direction, a second portion 20 that includes an entrance 21 into which a printing medium (e.g., paper) P that is a finishing process target may be inserted, a finishing unit 22 for performing a finishing process on the paper P and that extends from the first portion 10 in a lateral direction, a stacker 30 on which paper P discharged from the finishing unit 22 may be loaded and which extends in an opposite direction to the second portion 20 based on the first portion 10, and an elevation driving unit 40 that is provided in the second portion 20 to elevate the stacker 30 in the vertical direction.

The first portion 10 may extend in the vertical direction. The vertical direction may be a direction relative to a force of gravity. The vertical direction may be a stacking direction in which the paper P may be discharged from the finishing unit 22 and loaded on the stacker 30. As shown in FIGS. 1 and 2, when the finisher 2 is combined with a printing device 1, the first portion 10 is located outside the printing device 1. In an example, the first portion 10 may be located on a side of the printing device 1 in the lateral direction. The lateral direction may be a conveying direction of the paper P discharged from the finishing unit 22 into the stacker 30. The lateral direction may be a length direction L of the paper P passing through the finishing unit 22. A bottom end 101 of the first portion 10 may be spaced apart from an installation surface MS on which the finisher 2 and the printing device 1 are installed, for example, a bottom of an installation space, as shown in FIG. 1. The bottom end 101 of the first portion 10 may be in contact with the installation surface MS, as shown in FIG. 2. In this case, a support unit 102 supported at the installation surface MS may be provided on the bottom end 101 of the first portion 10. The support unit 102 may have various shapes, such as a foot, a roller, a caster, and the like.

The second portion 20 may extend from the first portion 10 in the lateral direction. In an example, the second portion 20 may extend from a top end 103 of the first portion 10 in the lateral direction. The second portion 20 may include the finishing unit 22 that performs one or more finishing processes on the paper P. The finishing process may include a bookbinding process for binding multiple sheets of aligned paper P, a folding process for folding one or more sheets of paper one or more times, or a punching process for punching one or more sheets of paper. In the illustrated example, the finishing unit 22 may perform a bookbinding process for binding multiple sheets of aligned paper P.

Referring to FIG. 3, the finishing unit 22 may include a paper alignment tray 221 on which a plurality of sheets of paper P, which are a finishing process target, may be aligned. The finishing unit 22 may also include a binder 222 to put a binding needle (e.g., staple) on the edge of the plurality of sheets of paper P. The binder 222 may be aligned with one edge of a distal end of the paper alignment tray 221 and may put the binding needle on the edge of the plurality of sheets of paper P.

A conveying structure for conveying the papers P may be disposed in the finishing unit 22. In an example, the conveying structure may include conveying rollers 223, 224, and 225, and an alignment member 226. Each of the conveying rollers 223, 224, and 225 may include a pair of rollers rotating while being engaged with each other and may convey the papers P inserted through the entrance 21. The alignment member 226 may be located above the paper alignment tray 221. The alignment member 226 may include a paddle having an elastic arm, for example. The paper P conveyed by the conveying rollers 223, 224, and 225 may be dropped into the paper alignment tray 221. The alignment member 226 may push the paper P on the paper alignment tray 221 toward an end guide 227 while being rotated. An end of the length direction L of the plurality of loaded sheets of paper P may be aligned by the end guide 227 on the paper alignment tray 221. The plurality of sheets of paper P loaded on the paper alignment tray 221 may be aligned by a pair of side guides 228 in a width direction W. Through this configuration, the plurality of sheets of paper P may be aligned on the paper alignment tray 221.

The binder 222 may put the binding needle on the edge of the plurality of sheets of paper P aligned on the paper alignment tray 221. The binder 222 may put the binding needle in one or more positions of the edge while being moved in the width direction W along the edge of the length direction L of the plurality of sheets of paper P aligned on the paper alignment tray 221. The plurality of sheets of paper P, of which a bookbinding process has been completed, may be pushed by an ejector 229 moved in the length direction L and may be discharged into the stacker 30.

The stacker 30 may extend to an opposite side of the second portion 20 in the lateral direction based on the first portion 10. The stacker 30 may be elevated in the vertical direction to increase a stacking capacity. The stacker 30 may be supported by the first portion 10 to be elevated in the vertical direction. The elevation driving unit 40 may elevate the stacker 30. The elevation driving unit 40 may be provided in the first portion 10. The elevation driving unit 40 may be implemented in various shapes. In an example, the elevation driving unit 40 may include, for example, a flexible circulating member 41 such as a flat belt, a timing belt, or a wire, which is supported by the first portion 10 to be able to circulate in the vertical direction, and a driving motor 42 for driving the circulating member 41. For example, the circulating member 41 may be supported by a pair of pulleys 43 and 44 that are spaced apart from each other in the vertical direction, and the driving motor 42 may rotate one of the pair of pulleys 43 and 44. The stacker 30 may be connected to the circulating member 41. Through this configuration, a control unit (not shown) may drive the driving motor 42 according to the number of sheets of paper P loaded on the stacker 30 to elevate the stacker 30 in the vertical direction to a suitable position.

The stacking capacity of the stacker 30 depends on the weight of the stacker 30 including the loaded paper P. The driving motor 42 may be sized to drive the weight of the stacker 30 and the weight of the maximum number of sheets of paper P that may be loaded. In a finisher of the related art in which an elevation driving unit is provided in a stacker, a driving motor needs to have a torque that is sufficient to drive the weight of a stacker itself, the weight of the maximum number of sheets of paper P loaded, and a weight of the elevation driving unit. In that case, when the stacking capacity of the stacker is increased, the driving motor having a large torque needs to be employed. However, because the driving motor having a large torque is usually heavier, it is not easy to increase the stacking capacity of the stacker.

In the finisher 2 according to an example, the elevation driving unit 40 for elevating the stacker 30 may be installed in the first portion 10. Thus, the driving motor 42 may have a torque that is sufficient to drive the weight of the stacker 30 and the weight of the paper P loaded thereon. Thus, it is easy to increase the stacking capacity of the stacker 30 and the finisher 2, in which the elevation driving unit 40 is provided in the first portion 10, is suitable for large-capacity.

The printing device 1 may include a printing unit 11 that prints an image on a print medium, for example, the paper P. The finisher 2 may perform a finishing process on the paper P discharged from the printing unit 11. The printing unit 11 may print an image on the paper P by using various printing methods, such as an electrophotographic method, an inkjet method, a thermal transfer method, a heat sublimation method, or the like. The paper P may be supplied to the printing unit 11 from a paper feeding unit. The paper feeding unit may include one or more cassette feeders located under the printing unit 11, for example, at least one of a main cassette feeder 12, a secondary cassette feeder 13, and a high capacity feeder 14. The paper feeding unit may also include a multi-purpose paper feeding tray (not shown).

The printing device 1 may further include a scanner unit 15 to read an image recorded on a document. The scanner unit 15 may be located on the printing unit 11. The scanner unit 15 may have various structures, such as a flatbed structure, whereby an image is read while the document is located at a fixed position and a reading member is moved, a document feed method, whereby the reading member is located at the fixed position and the document is conveyed, and a composite method thereof.

A concave loading portion 16 may be provided between the printing unit 11 and the scanner unit 15. The paper P discharged from the printing unit 11 may be discharged into the loading portion 16. The paper P may be discharged from one side of the lateral direction of the loading portion 16 toward the other side. The other side of the lateral direction of the loading portion 16 may be open. The front of the loading portion 16 may also be open. The rear of the loading portion 16 may also be open. A user may access the paper P through the other side or the front of the loading portion 16.

The finisher 2 may be attached to and detached from the printing device 1. The finisher 2 may be mounted on the printing device 1 to form an image forming apparatus. A finisher, having a structure in which a finishing unit is accommodated in a first portion, may be located at a side of the printing device 1 in a lateral direction, entirely. In order to supply the paper P discharged from the printing unit 11 to the finisher, a relay conveying module for conveying the paper P across the loading portion 16 in the lateral direction may be installed in the loading portion 16.

In a finisher 2 according to an example, the second portion 20 including the finishing unit 22 may extend from the first portion 10 in the lateral direction. The finisher 2 may have a structure in which the second portion 20 including the finishing unit 22 is mounted between the printing unit 11 and the scanner unit 15 of the printing device 1. The first portion 10 may be located on the side of the printing device 1 in the lateral direction. Referring to FIGS. 1 and 2, when the finisher 2 is combined with the printing device 1, the second portion 20 that extends from the first portion 10 in the lateral direction may be inserted into the concave loading portion 16. Although not shown, a first mounting portion may be provided in the second portion 20, and a second mounting portion on which the first mounting portion is seated, may be provided in the loading portion 16 of the printing device 1. The first mounting portion and the second mounting portion may be implemented by, for example, a first rail and a second rail, which extend in the lateral direction and have complementary shapes. A locking device for locking the finisher 2 in a mounting position may be provided on the second rail. After the first rail is fitted to the second rail, the finisher 2 may be pushed in the lateral direction and located in the mounting position so that the finisher 2 may be mounted in the printing device 1. In the example of FIG. 1, the weight of the finisher 2 may be supported by the second rail. The finishing unit 22 may be located in the loading portion 16, and the entrance 21 may be aligned with a paper discharge port (e.g., a first paper discharge portion 18-1) of the printing device 1. The paper P discharged from the printing unit 11 may be directly supplied to the finishing unit 22. Thus, a low-priced finisher 2 having a compact paper conveying structure that does not require a relay conveying module may be implemented. The locking device may be released, and the finisher 2 may be moved in the lateral direction and separated from the printing device 1.

When the finisher 2 is combined with the printing device 1, the second portion 20 is included in a foot-print of the printing device 1. Here, the foot-print of the finisher 2 depends on the length of the lateral direction of the stacker 30 and the length of the lateral direction of the first portion 10. The length of the lateral direction of the stacker 30 depends on the size of the paper P. As described above, since the elevation driving unit 40 for elevating the stacker 30 in the vertical direction is installed in the first portion 10, the first portion 10 of the finisher 2 may be more compact as compared to a finisher having a structure in which a finishing unit is accommodated in a first portion. The length of the lateral direction of the first portion 10 may be smaller than the length of the lateral direction of the second portion 20. Thus, the foot-print of the image forming apparatus formed when the finisher 2 is mounted on the printing device 1, may be reduced.

The second portion 20 may include a second stacker 50 on which the paper P of which finishing is not performed, is stacked. Referring to FIGS. 1 through 3, the second stacker 50 may be provided above the entrance 21. The top surface of the second portion 20 may function as the second stacker 50. The printing device 1 may have a first path 11-1 for a finishing process of the paper P discharged from the printing unit 11 and a second path 11-2 for discharging the paper P discharged from the printing unit 11. A path selection member 11-3 may selectively guide the paper P toward the first path 11-1 or the second path 11-2. The first path 11-1 may be connected to the first paper discharge port 18-1 opposite to the entrance 21 of the finishing unit 22. Thus, the paper P discharged along the first path 11-1 may be discharged into the stacker 30 via the finishing unit 22. The second path 11-2 may be connected to a second paper discharge port 18-2. The paper P discharged into the second paper discharge port 18-2 may be directly discharged into the second stacker 50. The user may access the paper P loaded on the second stacker 50 via the other side or the front of the loading portion 16.

A height of the loading portion 16, into which the finisher 22 may be inserted, may vary. For example, a height from the installation surface MS to the loading portion 16 may vary according to a configuration of the printing unit 11 of the printing device 1. Also, the height from the installation surface MS to the loading portion 16 may vary according to the configuration of a paper feeding unit located under the printing unit 11. For example, one, two, or three of the main cassette feeder 12, the secondary cassette feeder 13, and the high capacity feeder 14 may be installed under the printing unit 11. The height from the installation surface MS to the loading portion 16 may vary according to each combination.

In view these different combinations, the finisher 2 may include the first portion 10 that extends in a vertical direction, the second portion 20 that includes the finishing unit 22 for performing a finishing process on the paper P and extends from the first portion 10 in a lateral direction, the stacker 30 on which the paper P discharged from the finishing unit 22 is loaded and which extends in an opposite direction to the second portion 20 based on the first portion 10, and a height adjustment unit for adjusting the height from the installation surface MS of the second portion 20.

The height of the second portion 20 refers to the height from the installation surface MS on which the finisher 2 is installed, to the second portion 20. An example of a height adjustment unit that may be applied to the finisher 2 shown in FIG. 1, in which the bottom end 101 of the first portion 10 is spaced apart from the installation surface MS, will be described.

Figure 4:
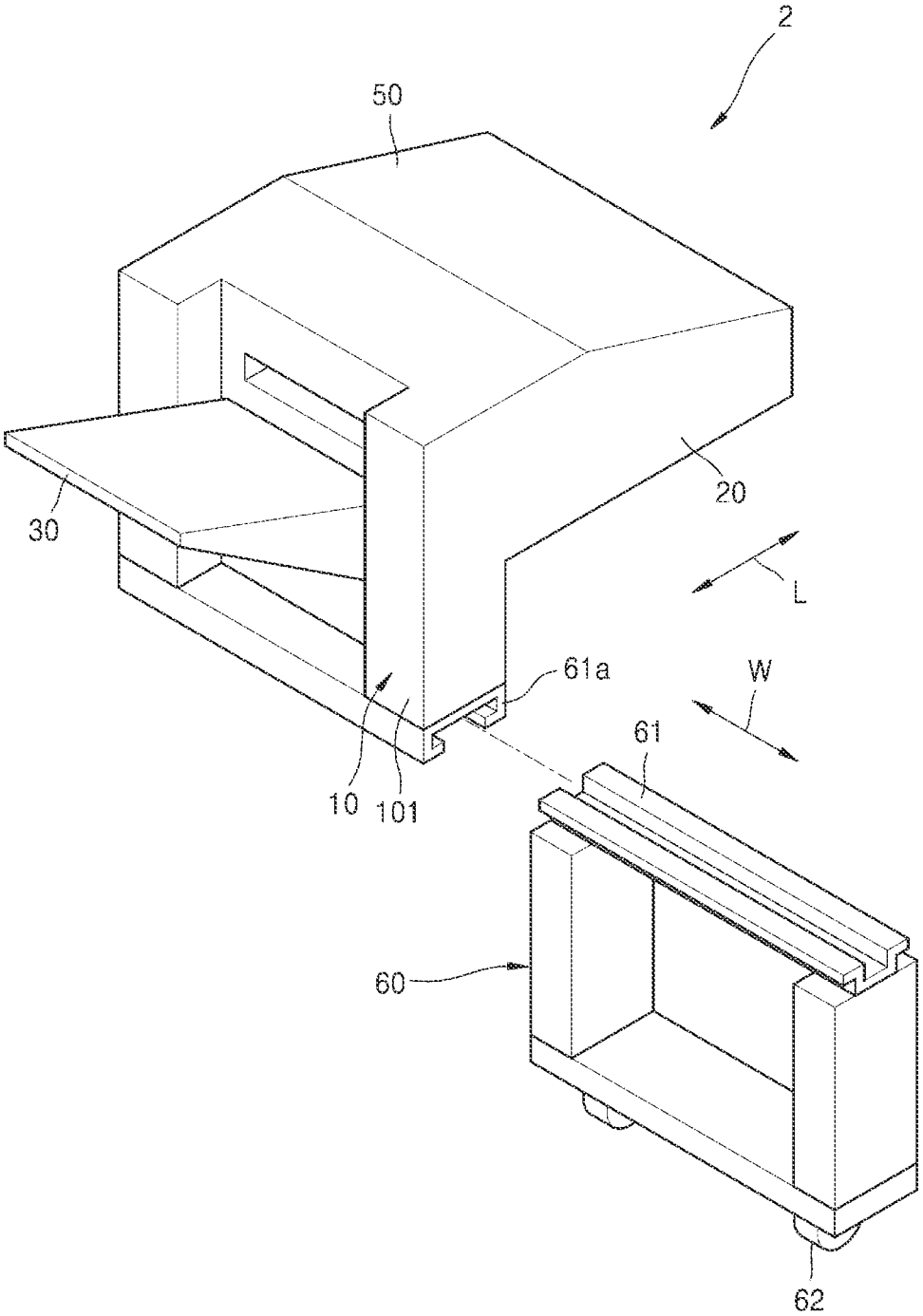
FIG. 4 is a schematic side view of a height adjustment unit according to an example.

FIG. 4 is a schematic side view of a height adjustment unit according to an example. Descriptions of the first portion 10, the second portion 20, the stacker 30, the elevation driving unit 40, and the second stacker 50 shown in FIGS. 1 through 3 may also be applied to the example of the finisher 2 shown in FIG. 4.

Referring to FIG. 4, the height adjustment unit may include a height adjustment member 60 that is removably combined with the bottom end 101 of the first portion 10. For example, a first slide rail 61*a* may be provided on the bottom end 101 of the first portion 10. A second slide rail 61 having a complementary shape with the first slide rail 61*a* may be provided on a top end of the height adjustment member 60. The first slide rail 61*a* and the second slide rail 61 may extend in the width direction W of the paper P, for example. The second slide rail 61 may slide in the width direction W and may be inserted into the first slide rail 61*a*. Thus, the height adjustment member 60 may be combined with the bottom end 101 of the first portion 10. The height adjustment member 60 having a suitable height according to the required height of the second portion 20 may be combined with the bottom end 101 of the first portion 10 to adjust the height of the second portion 20. A support portion 62 supported on the installation surface MS may be provided on the bottom end of the height adjustment member 60. The support portion 62 may have various shapes, such as a foot, a roller, and a caster, and the like.

Figure 5:
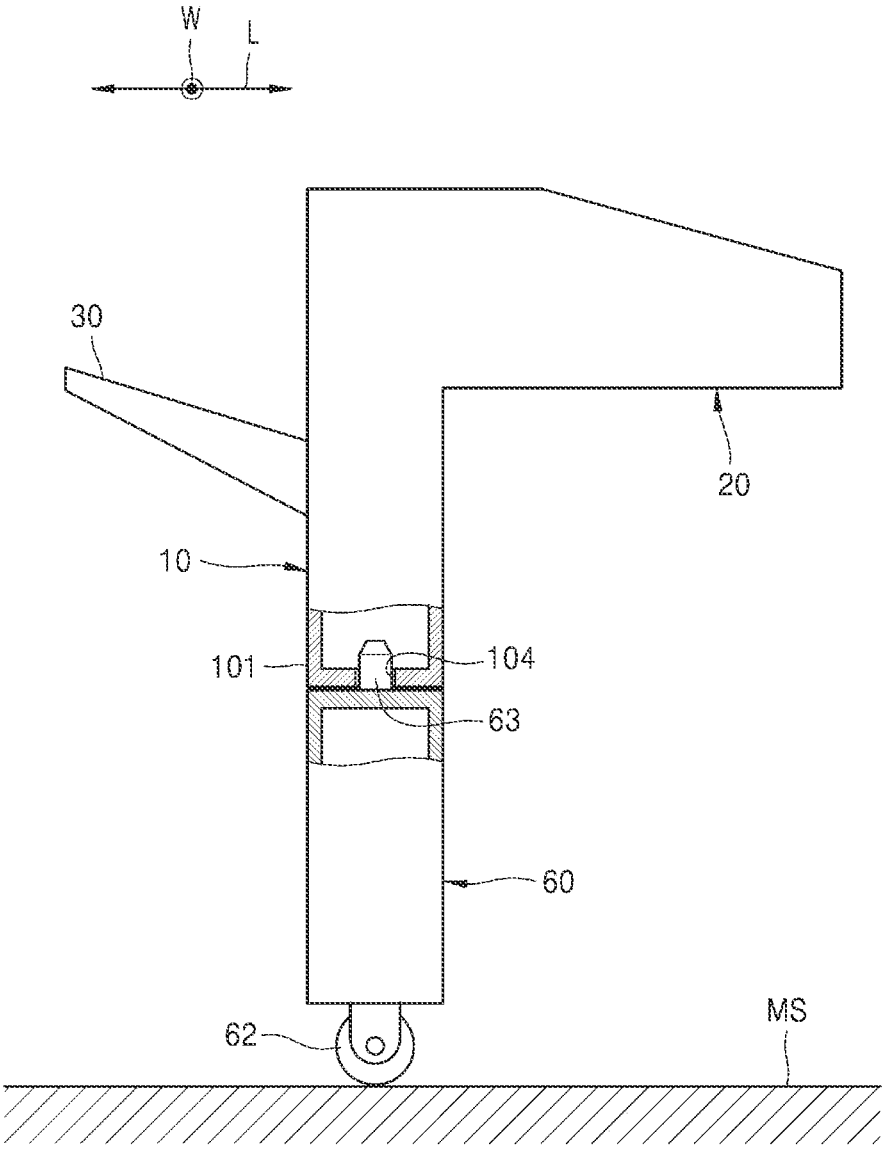
FIGS. 5 and 6 are views showing a method of combining a height adjustment member with a first portion according to an example.
Figure 6:
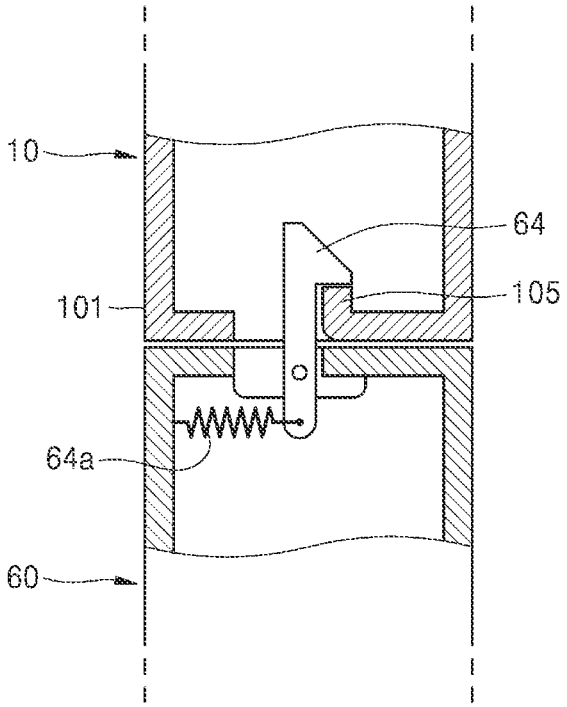
Figure 7:
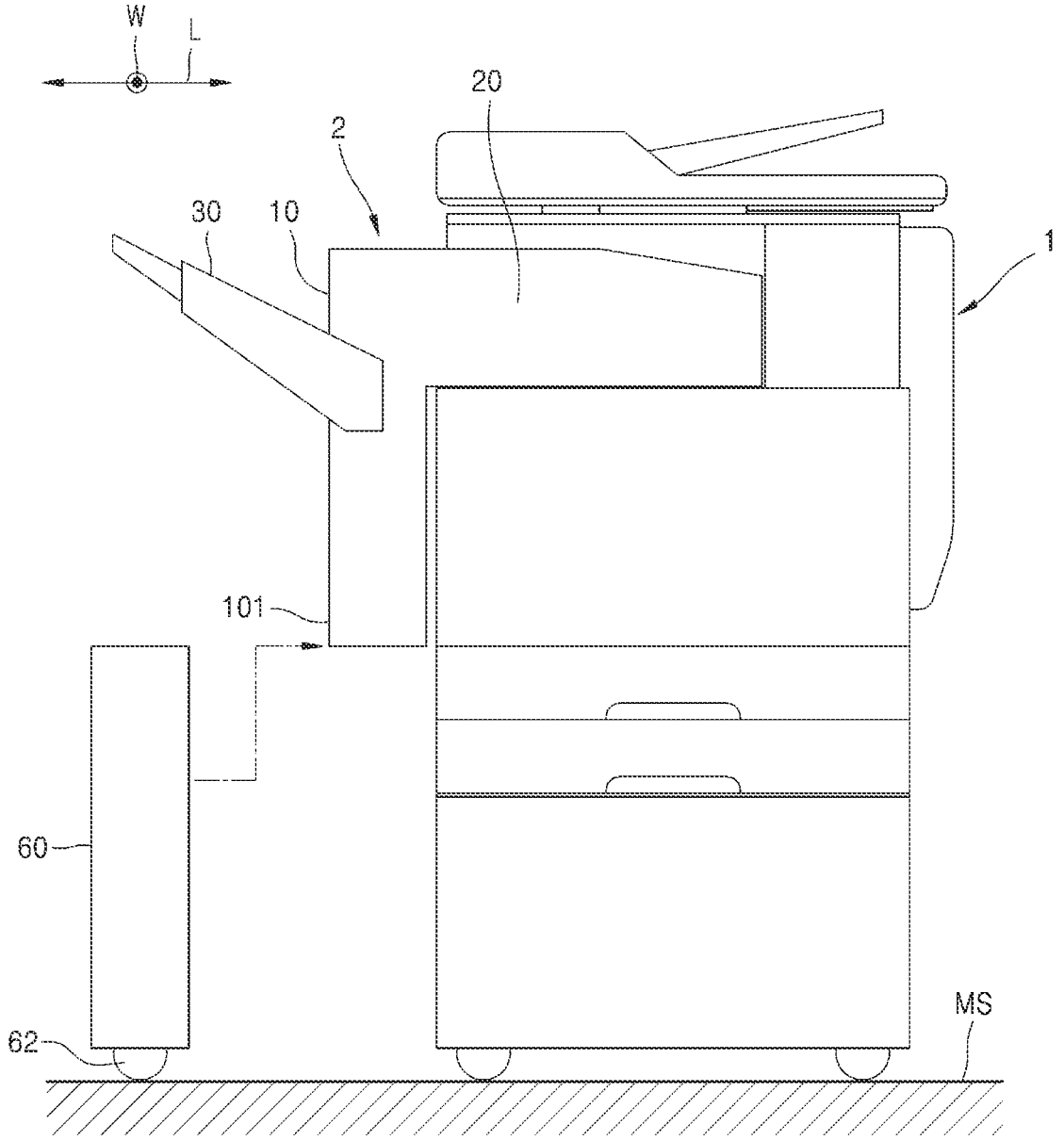
FIG. 7 is a view showing a state in which a height adjustment member is combined with a finisher that is combined with a printing device according to an example.

The height adjustment member 60 and the first portion 10 may be combined with each other by using various combining methods. FIGS. 5 and 6 are views showing a method of a combining the height adjustment member 60 and the first portion 10 according to an example. FIG. 7 is a view showing a state in which a height adjustment member is combined with a finisher that is combined with a printing device according to an example.

In an example, the first portion 10 and the height adjustment member 60 may be combined with each other through a combination hole-boss combination structure. A combination hole may be provided in one of the bottom end 101 of the first portion 10 and the top end of the height adjustment member 60, and a combination boss insertable into the combination hole may be provided on another one of the bottom end 101 of the first portion 10 and the top end of the height adjustment member 60. Referring to FIG. 5, a combination hole 104 may be provided in the bottom end 101 of the first portion 10, and a combination boss 63, insertable into the combination hole 104, may be provided on the top end of the height adjustment member 60.

In an example, the first portion 10 and the height adjustment member 60 may be combined with each other through a hook combination structure. A hook may be provided on one of the bottom end 101 of the first portion 10 and the top end of the height adjustment member 60, and a protrusion jaw on which the hook is to be caught, may be provided on another one of the bottom end 101 of the first portion 10 and the top end of the height adjustment member 60. Referring to FIG. 6, a protrusion jaw 105 may be provided on the bottom end 101 of the first portion 10, and a hook 64, to be caught in the protrusion jaw 105, may be provided on the top end of the height adjustment member 60. The hook 64 may be elastically biased in a direction in which the hook 64 is caught in the protrusion jaw 105 by means of a spring 64*a*.

In a state in which the height adjustment member 60 shown in FIGS. 4 through 6 is mounted on the bottom end 101 of the finisher 2 shown in FIG. 1, the finisher 2 may be combined with the printing device 1. Also, as shown in FIG. 7, after the finisher 2 is mounted on the printing device 1, the height adjustment member 60 may also be combined with the bottom end 101 of the first portion 10.

As shown in FIG. 2, in a structure in which the first portion 10 is supported on the installation surface MS, the first portion 10 may extend in the vertical direction to adjust the height of the second portion 20. Hereinafter, examples of a height adjustment unit for extending the first portion 10 in the vertical direction will be described.

Figure 8:
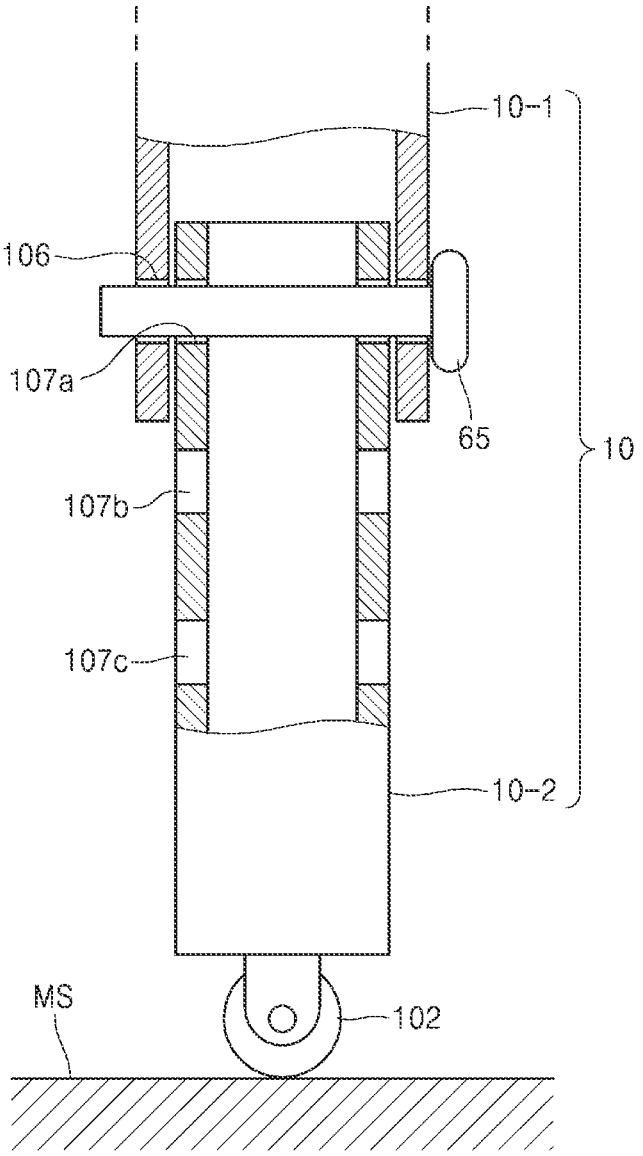
FIG. 8 is a schematic side view of a height adjustment unit for extending a first portion in a vertical direction, according to an example.

FIG. 8 is a schematic side view of a height adjustment unit for extending the first portion 10 in the vertical direction according to an example. Descriptions of the first portion 10, the second portion 20, the stacker 30, the elevation driving unit 40, and the second stacker 50 shown in FIGS. 1 through 3 may also be applied to the example of the finisher 2 shown in FIG. 8.

Referring to FIG. 8, the first portion 10 may include a third portion 10-1 supporting the second portion 20 and the stacker 30, and a fourth portion 10-2 that may be selectively combined in a plurality of positions of a bottom end of the third portion 10-1 in the vertical direction. The height adjustment unit may be implemented by the fourth portion 10-2 that may be selectively combined with a plurality of positions of the bottom end of the third portion 10-1 in the vertical direction. A first combination hole may be provided in one of the third portion 10-1 and the fourth portion 10-2, and a plurality of second combination holes, which are spaced apart from one another in the vertical direction, may be provided in another one of the third portion 10-1 and the fourth portion 10-2. In an example, the fourth portion 10-2 may be inserted into the third portion 10-1 and may be movable in the vertical direction. A first combination hole 106 may be provided in the third portion 10-1, and a plurality of second combination holes 107*a*, 107*b*, and 107*c*, which are spaced apart from one another in the vertical direction, may be provided in the fourth portion 10-2. When, in a state in which a second combination hole 107*a* positioned at the top and the first combination hole 106 are aligned, a combination pin 65 may be inserted into the first combination hole 106 and the second combination hole 107*a* and the height of the second portion 20 becomes highest. When, in a state in which a second combination hole 107*c* positioned at the bottom and the first combination hole 106 are aligned, the combination pin 65 may be inserted into the first combination hole 106 and the second combination hole 107*c* and the height of the second portion 20 becomes lowest. One of the plurality of second combination holes 107*a*, 107*b*, and 107*c* may be aligned with the first combination hole 106, and the third portion 10-1 and the fourth portion 10-2 may be combined with each other by using the combination pin 65 so that the height of the second portion 20 may be adjusted. A support portion 102 may be provided on the bottom end of the fourth portion 10-2.

Figure 9:
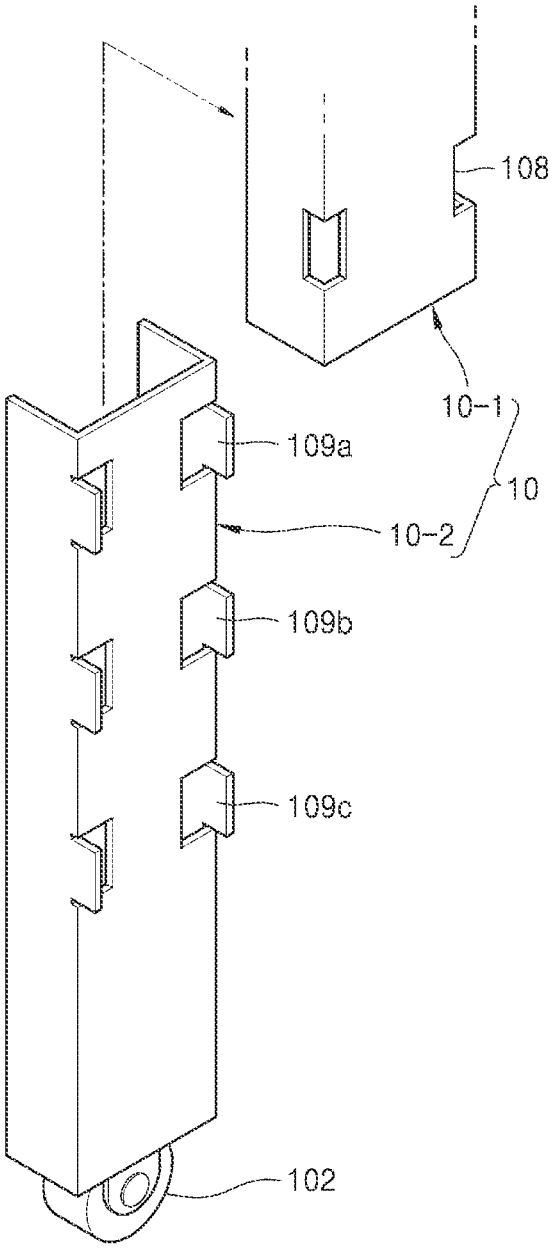
FIGS. 9 and 10 are views showing a method of combining a third portion with a fourth portion according to an example.
Figure 10:
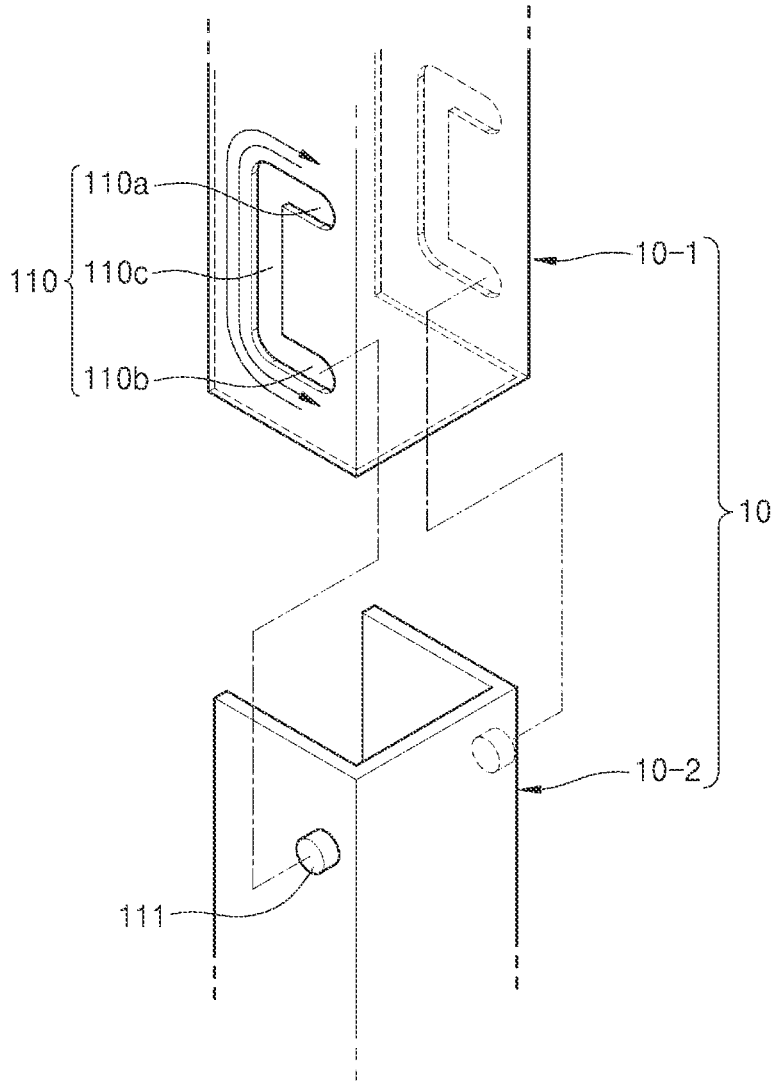

The third portion 10-1 and the fourth portion 10-2 may be combined with each other by using various combining methods. FIGS. 9 and 10 are views showing a method of combing the third portion 10-1 with the fourth portion 10-2 according to an example.

In an example, the third portion 10-1 and the fourth portion 10-2 may be combined with each other by a slot-combination piece structure. A slot may be provided in one of the third portion 10-1 and the fourth portion 10-2, and a plurality of combination pieces, which are spaced apart from one another in the vertical direction and into which the slot may be inserted, may be provided in another one of the third portion 10-1 and the fourth portion 10-2. Referring to FIG. 9, the fourth portion 10-2 may be inserted into the third portion 10-1 and may be movable in the vertical direction. A slot 108 may be provided in the third portion 10-1, and a plurality of combination pieces 109*a*, 109*b*, and 109*c*, which are spaced apart from one another in the vertical direction, may be provided in the fourth portion 10-2. One of the plurality of combination pieces 109*a*, 109*b*, and 109*c* may be inserted into the slot 108 so that the height of the second portion 20 may be adjusted.

In an example, the third portion 10-1 and the fourth portion 10-2 may be combined with each other through a pin-guide structure. A guide including at least two fixing guides which are spaced apart from each other in the vertical direction and a connection guide for connecting the at least two fixing guides in the vertical direction, may be provided on one of the third portion 10-1 and the fourth portion 10-2, and a pin inserted into the guide may be provided on another one of the third portion 10-1 and the fourth portion 10-2. Referring to FIG. 10, the fourth portion 10-2 may be inserted into the third portion 10-1 and may be movable in the vertical direction. A guide 110 may be provided on the third portion 10-1, and a pin 111 inserted into the guide 110 may be provided on the fourth portion 10-2. The guide 110 may include a plurality of fixing guides 110*a* and 110*b*, which are spaced apart from each other in the vertical direction, and a connection guide 110*c* for connecting the plurality of fixing guides 110*a* and 110*b* in the vertical direction. The connection guide 110*c* may connect one end of each of the fixing guides 110*a* and 110*b* to each other. The fourth portion 10-2 may be moved along the guide 110 so that the pin 111 may be inserted into one of the plurality of fixing guides 110*a* and 110*b* and thus the third portion 10-1 and the fourth portion 10-2 may be combined with each other. Thus, the height of the second portion 20 may be adjusted.

Figure 11:
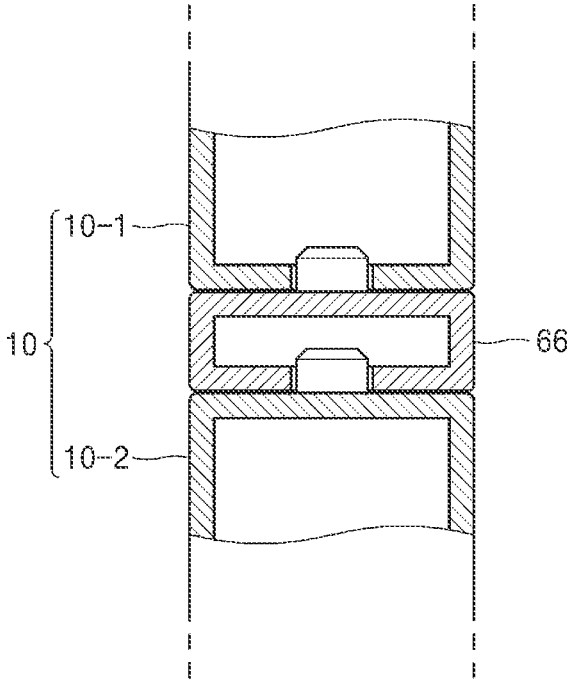
FIG. 11 is a schematic configuration diagram of a height adjustment unit according to an example.

FIG. 11 is a schematic configuration diagram of a height adjustment unit according to an example. Descriptions of the first portion 10, the second portion 20, the stacker 30, the elevation driving unit 40, and the second stacker 50 shown in FIGS. 1 through 3 may also be applied to the example of the finisher 2 shown in FIG. 11.

Referring to FIG. 11, the first portion 10 may include a third portion 10-1 supporting the second portion 20 and the stacker 30, and a fourth portion 10-2 located at the bottom end of the third portion 10-1. The height adjustment unit may include a spacer 66 between the third portion 10-1 and the fourth portion 10-2. The spacer 66 is replaceable. For example, the fourth portion 10-2 and the spacer 66, and the spacer 66 and the third portion 10-1 may be combined with each other by the combination hole-boss combination structure shown in FIG. 5. The spacer 66 having a suitable height may be inserted between the third portion 10-1 and the fourth portion 10-2 according to the required height of the second portion 20. A plurality of spacers 66 may be inserted between the third portion 10-1 and the fourth portion 10-2. In this case, the heights of the plurality of spacers 66 may be the same or different. The plurality of spacers 66 may be combined with one another by the combination hole-boss combination structure.

Referring again to FIG. 5, before the finisher 2 is combined with the printing device 1, a support portion (e.g., a first support portion) 62 provided on the bottom end 101 of the first portion 10 may be supported on the installation surface MS. In this state, the finisher 2 may fall over due to the weight of the second portion 20. For handling convenience, the finisher 2 needs not to fall over even when the finisher 2 is separated from the printing device 1.

Figure 12:
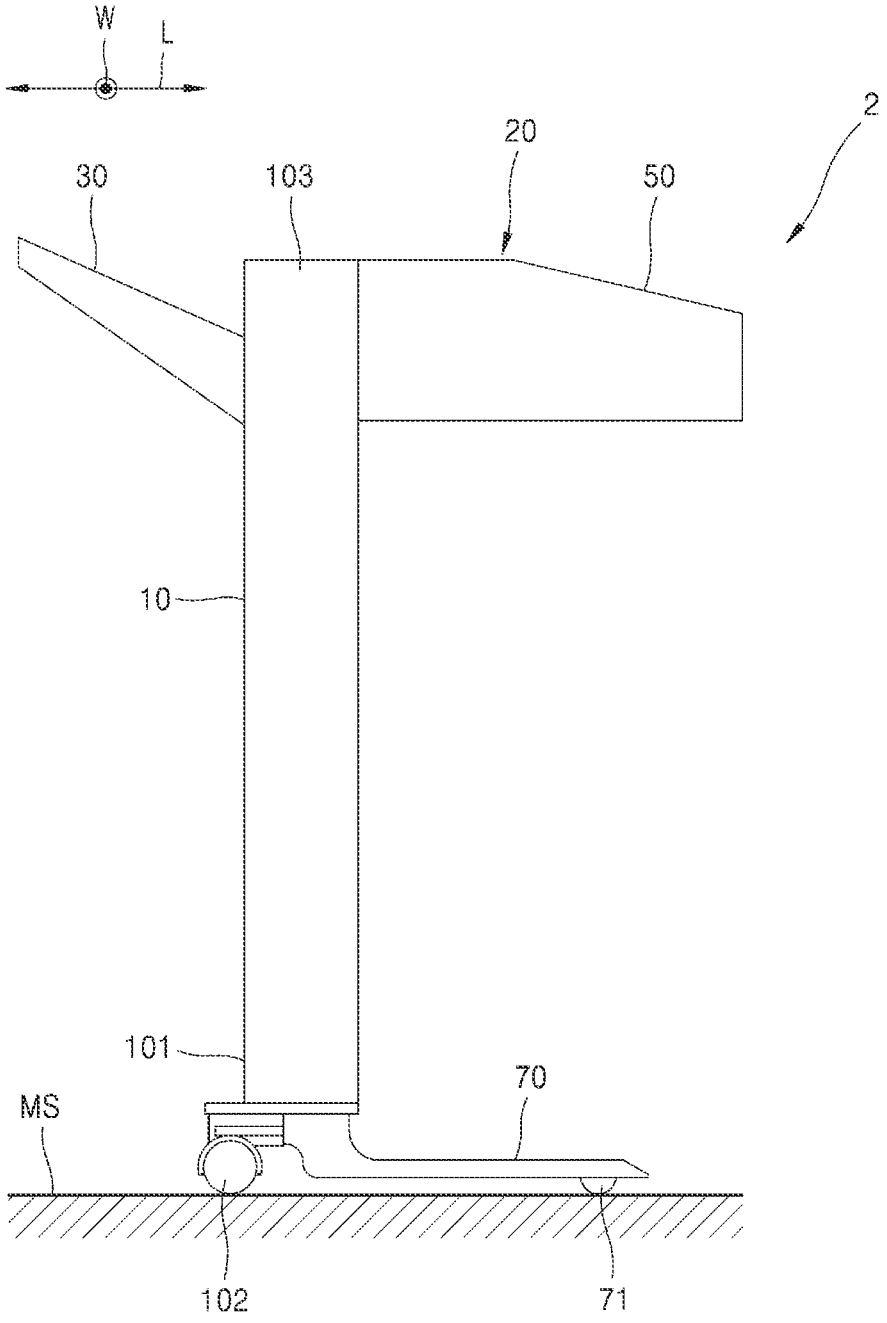
FIG. 12 is a schematic side view of a finisher according to an example.
Figure 13:
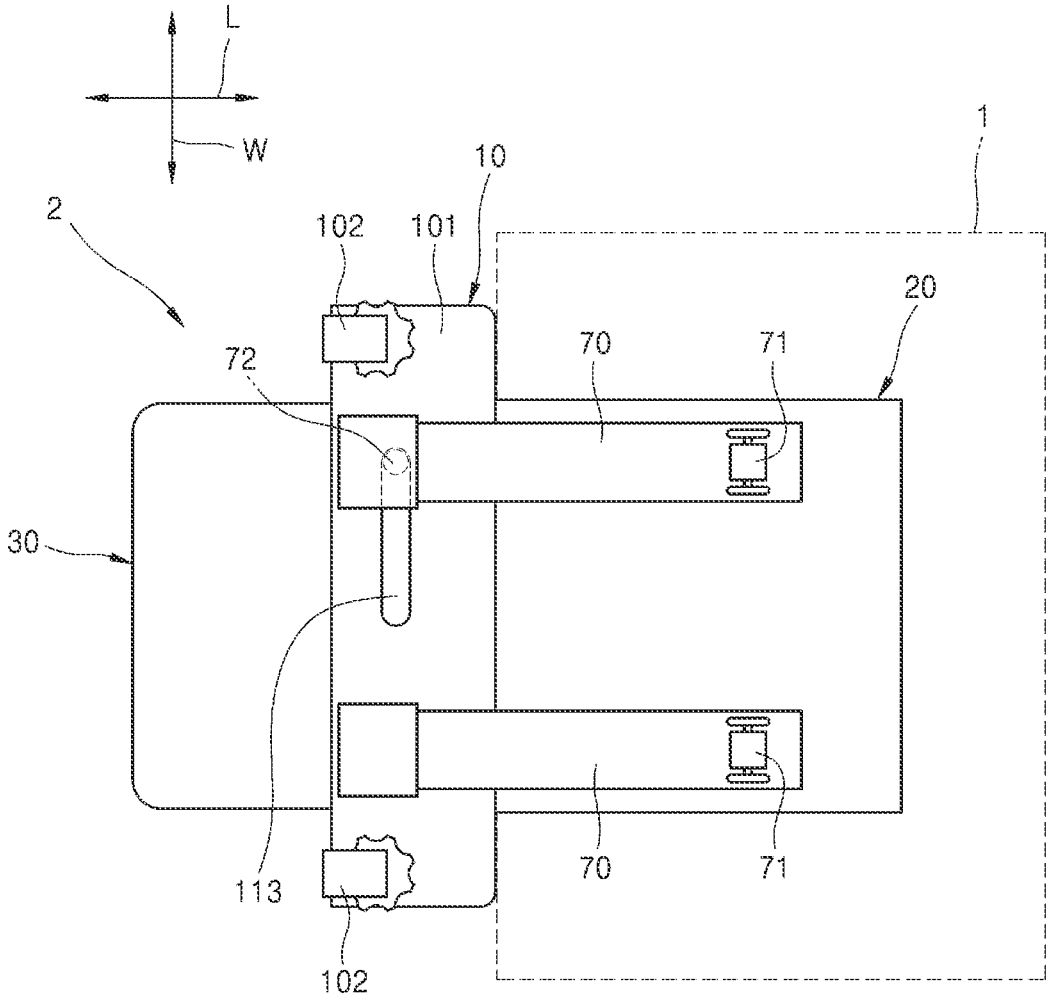
FIG. 13 is a bottom view of the finisher shown in FIG. 12, according to an example.

FIG. 12 is a schematic side view of the finisher 2 according to an example. FIG. 13 is a bottom view of the finisher 2 shown in FIG. 12, according to an example. Descriptions of the first portion 10, the second portion 20, the stacker 30, the elevation driving unit 40, and the second stacker 50, and the structure for adjusting the height of the second portion shown in FIGS. 4 through 11 may also be applied to the example of the finisher 2 shown in FIG. 12.

Referring to FIGS. 12 and 13, the finisher 2 may include a first portion 10 that extends in the vertical direction and includes a first support portion 102 supported on the installation surface MS, a second portion 20 that includes a finishing portion (see 22 of FIG. 3) for performing a finishing process on the paper P and extends from the first portion 10 in the lateral direction, a stacker 30 on which paper P discharged from the finishing unit 22 may be loaded and which extends in an opposite direction to the second portion 20 based on the first portion 10, and a fall-over reduction member including a second support portion 71 supported on the installation surface MS below the second portion 20 and supporting a load of the second portion 20.

An example of the fall-over reduction member may include a bottom end support 70 that extends from the bottom end 101 of the first portion 10 below the second portion 20 and includes the second support portion 71. Referring to FIG. 12, the bottom end support 70 may extend from the bottom end 101 of the first portion 10 in the lateral direction. The second support portion 71 may be provided near the extended end of the bottom end support 70. The second support portion 71 may have various shapes, such as a foot, a roller, a caster, and the like, which are supported on the installation surface MS. Thus, an occurrence of the fall-over of the finisher 2 in the lateral direction. i.e., in the length direction L, may be reduced. Also, in an example, two bottom end supports 70 may be provided. Two bottom end supports 70 may be spaced apart from each other in the width direction W of the paper P. Thus, an occurrence of the fall-over of the width direction W of the finisher 2 may be reduced.

At least one of two bottom end supports 70 may be supported by the first portion 10 to be movable in the width direction W of the paper P. In an example, a guide slot 113 that extends in the width direction W may be provided on the bottom end 101 of the first portion 10. A guide pin 72 insertable into the guide slot 113 may be provided on the bottom end support 70. Through this configuration, the bottom end support 70 may be moved in the width direction W along the guide slot 113. A support member such as a foot, a roller, a caster, and the like, which is supported on the installation surface MS, may be provided on a lower portion of the printing device 1. When the finisher 2 is combined with the printing device 1, the bottom end support 70 may be inserted into or below a lower portion of the printing device 1. In this case, the bottom end support 70 may interfere with a support member of the printing device 1. In this case, after the bottom end support 70 is moved in the width direction W and is located in a position in which the bottom end support 70 does not interfere with the support member, the finisher 2 may be combined with the printing device 1. In FIG. 12, one bottom end support 70 is movable in the width direction W. However, each of two bottom end supports 70 may be supported on the bottom end 101 of the first portion 10 to be movable in the width direction W.

Figure 14:
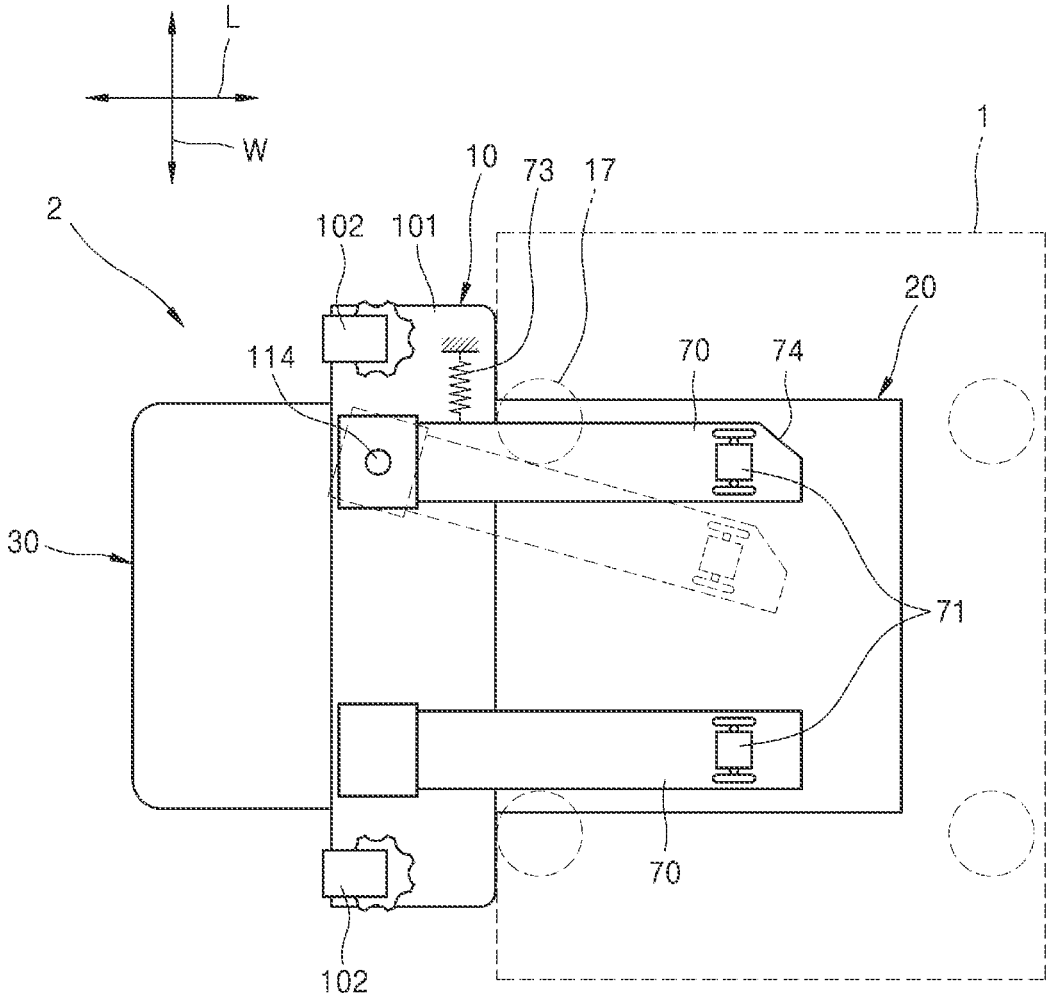
FIG. 14 is a bottom view of a finisher according to an example.

FIG. 14 is a bottom view of the finisher 2 according to an example. Referring to FIG. 14, the bottom end support 70 may be rotatably supported by the first portion 10 between a first position (solid line of FIG. 14) extending outward in the width direction W of the paper P and a second position (dashed line of FIG. 14) closing inward in the width direction W. For example, the bottom end support 70 may be supported on the bottom end 101 of the first portion 10 to be rotatable around a hinge 114. A first elastic member 73 may apply an elastic force to the bottom end support 70 in a direction of the first position. In an example, the first elastic member 73 may be implemented by a tensile coil spring of which one end and another end are respectively connected to the bottom end support 70 and the bottom end 101 of the first portion 10.

When the finisher 2 is combined with the printing device 1, the bottom end support 70 may be inserted into or below the lower portion of the printing, device 1. In this case, the bottom end support 70 located in the first position may interfere with a support member 17 provided on a bottom surface of the printing device 1. In this case, the bottom end support 70 may interfere with the support member 17 and may be rotated toward the second position, as shown by the dashed line of FIG. 14. An inclination portion 74 may be provided on an end of the lateral direction of the bottom end support 70, may interfere with the support member 17, and may be inclined at an acute angle with respect to the lateral direction to be stably rotatable toward the second position.

Through this configuration, the finisher 2 may be stably combined with the printing device 1. When the finisher 2 is detached from the printing device 1, the bottom end support 70 may be returned toward the first position, and the finisher 2 may be stably supported by the first support portion 102 and the second support portion 71 to reduce an occurrence of falling over.

Figure 15:
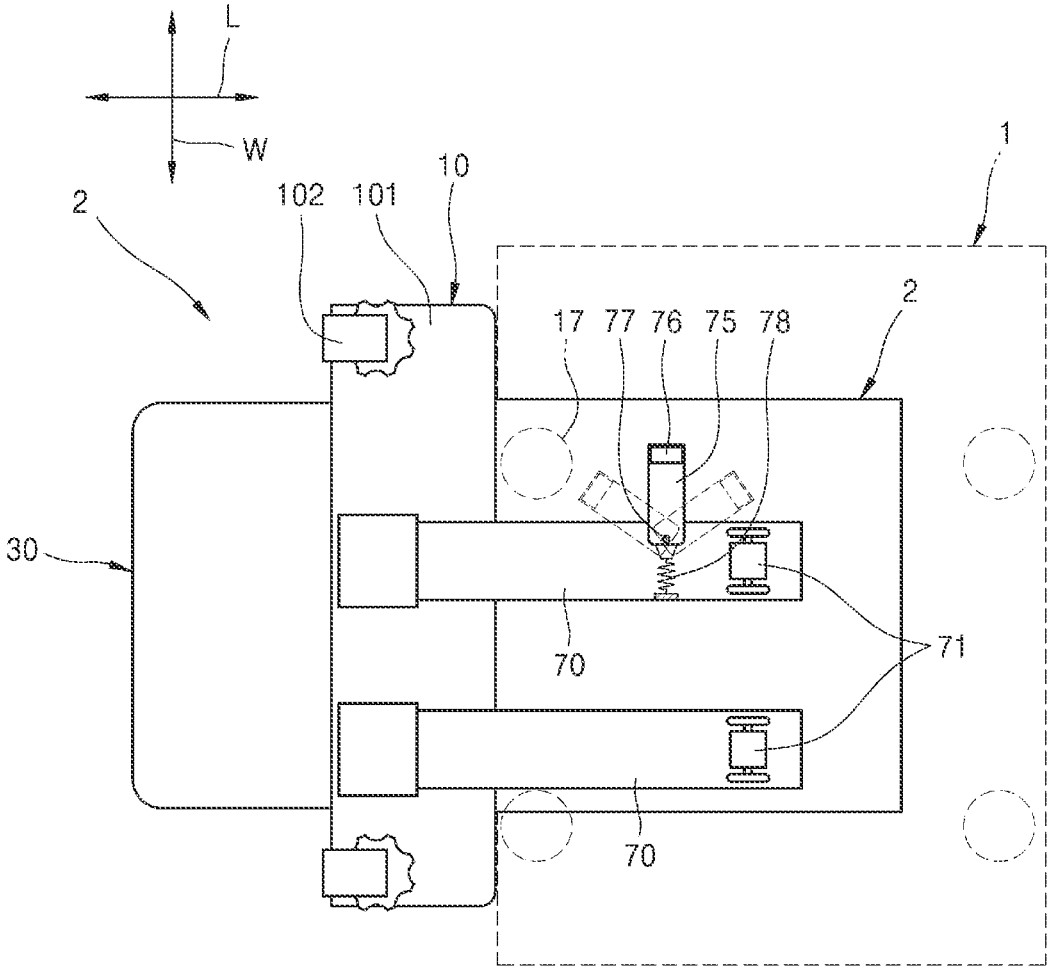
FIG. 15 is a bottom view of a finisher according to an example.

FIG. 15 is a bottom view of the finisher 2 according to an example. Referring to FIG. 15, the finisher 2 may include a rotation support 75 installed on the bottom end support 70 to be rotatable between an extending position (solid line of FIG. 15) extending outward in the width direction W of the paper P and a reduced position (dashed line of FIG. 15) closing inward in the width direction W from the extending position, and a second elastic member 78 that applies an elastic force to the rotation support 75 in a direction of the extending position. In an example, the rotation support 75 may be supported by the bottom end support 70 to be rotatable around a hinge 77. A third support portion 76 may be provided on an end of the width direction W of the rotation support 75. The third support portion 76 may be supported on the installation surface MS. The third support portion 76 may be spaced apart from the installation surface MS upward, and when the finisher 2 is inclined in the width direction W, the third support portion 76 may be supported on the installation surface MS so that the finisher 2 may reduce an occurrence of falling over. The second elastic member 78 may be implemented by a tensile coil spring having one end connected to an end of the rotation support 75 opposite to the third support portion 76 and another end connected to the bottom end support 70.

The bottom end support 70 may be located outward in the width direction W so that the finisher 2 may reduce an occurrence of falling over in the width direction W. However, the bottom end support 70 may be fixed at the first portion 10 in a position in which the bottom end support 70 is moved inward in the width direction W to reduce interference with the support member 17 of the printing device 1. That is, the bottom end support 70 may slide inward in the width direction W to reduce interference with the support member 17 of the printing device 1. In this case, the stability of the finisher 2 with respect to falling-over in the width direction W may be deteriorated.

According to an example, the rotation support 75 may extend from the bottom end support 70 in the width direction W, and the third support portion 76 provided on the extending end may be supported on the installation surface MS, or the third support portion 76 may be slightly spaced apart from the installation surface MS upward and when then the finisher 2 is inclined in the width direction W, the third support portion 76 may be supported on the installation surface MS so that the finisher 2 may reduce an occurrence of falling over. Thus, in a state in which the finisher 2 is separated from the printing device 1, stability of conduction of the width direction W of the finisher 2 may be improved.

Figure 16:
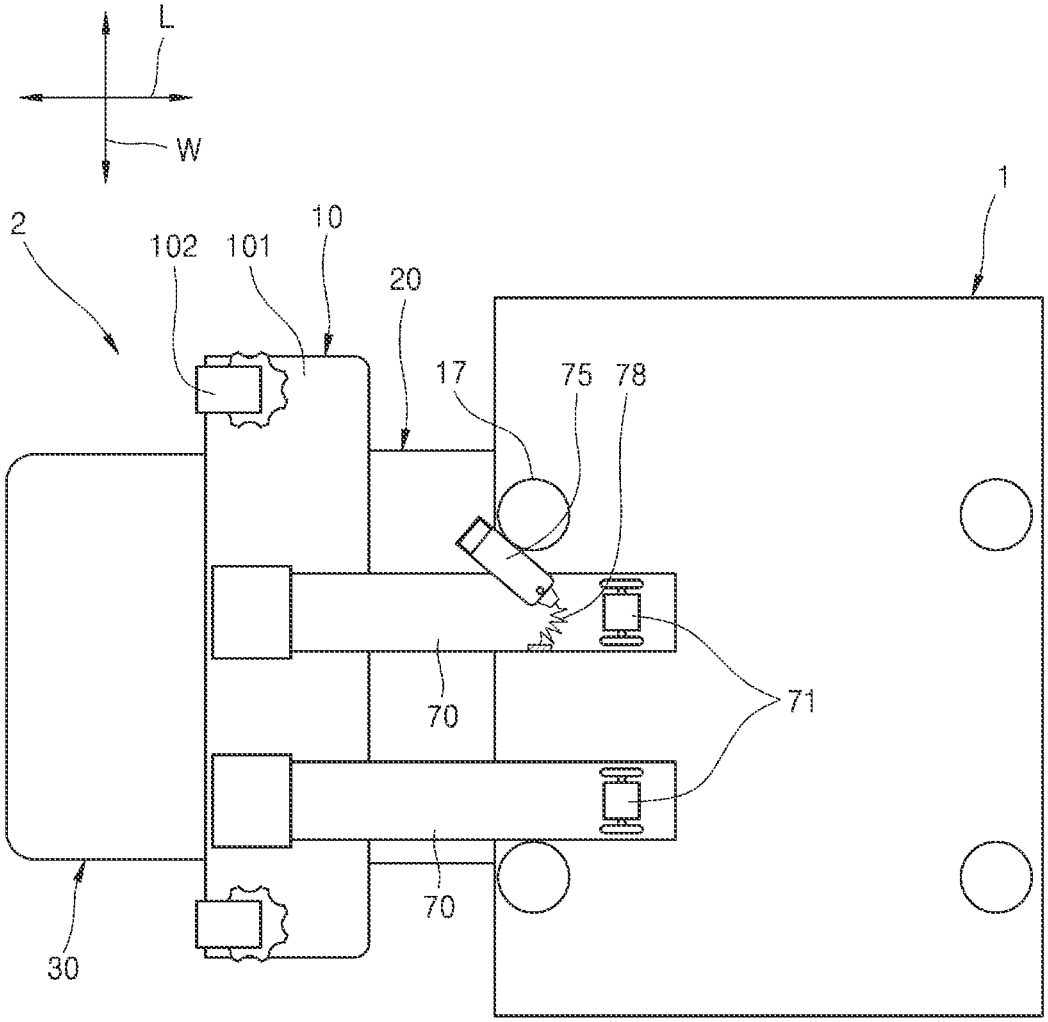
FIGS. 16 and 17 are bottom views showing a procedure in which the finisher shown in FIG. 15 is combined with a printing device according to an example.
Figure 17:
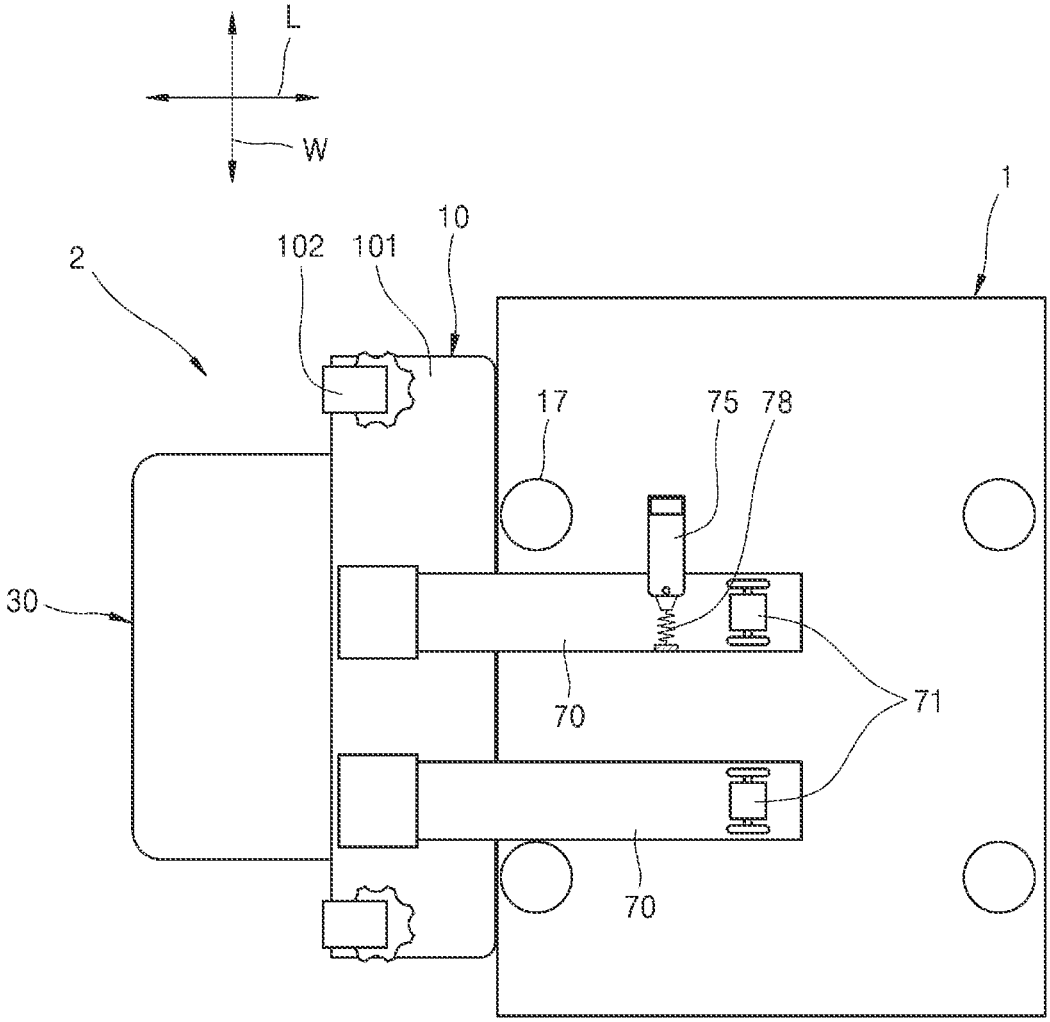

The rotation support 75 may be elastically rotated in the extending position and the reduced position. FIGS. 16 and 17 are bottom views showing a procedure in which the finisher 2 shown in FIG. 15 according to an example is combined with the printing device 1.

Referring to FIG. 15, in a state in which the finisher 2 is detached from the printing device 1, the rotation support 75 may be located in the extending position extending in the width direction W. In this case, when the finisher 2 is moved in the lateral direction to be combined with the printing device 1, the bottom end support 70 may be inserted into or below the lower portion of the printing device 1. In this case, the support member 17 located at the lower portion of the printing device 1 may interfere with the rotation support 75. In that case, the rotation support 75 may be elastically rotated in the reduced position, as shown in FIG. 16. When interference of the support member 17 with the rotation support 75 is ended, the rotation support 75 may be returned to the extending position due to the elastic force of the second elastic member 78 as shown in FIG. 17. When the finisher 2 is combined with the printing device 1, the rotation support 75 may be maintained in the extending position. Thus, even when the finisher 2 is combined with the printing device 1, stability of conduction of the width direction W of the finisher 2 may be improved. The rotation support 75 and the second elastic member 78 may also be applied to the example of the finisher 2 shown in FIG. 14.

Figure 18:
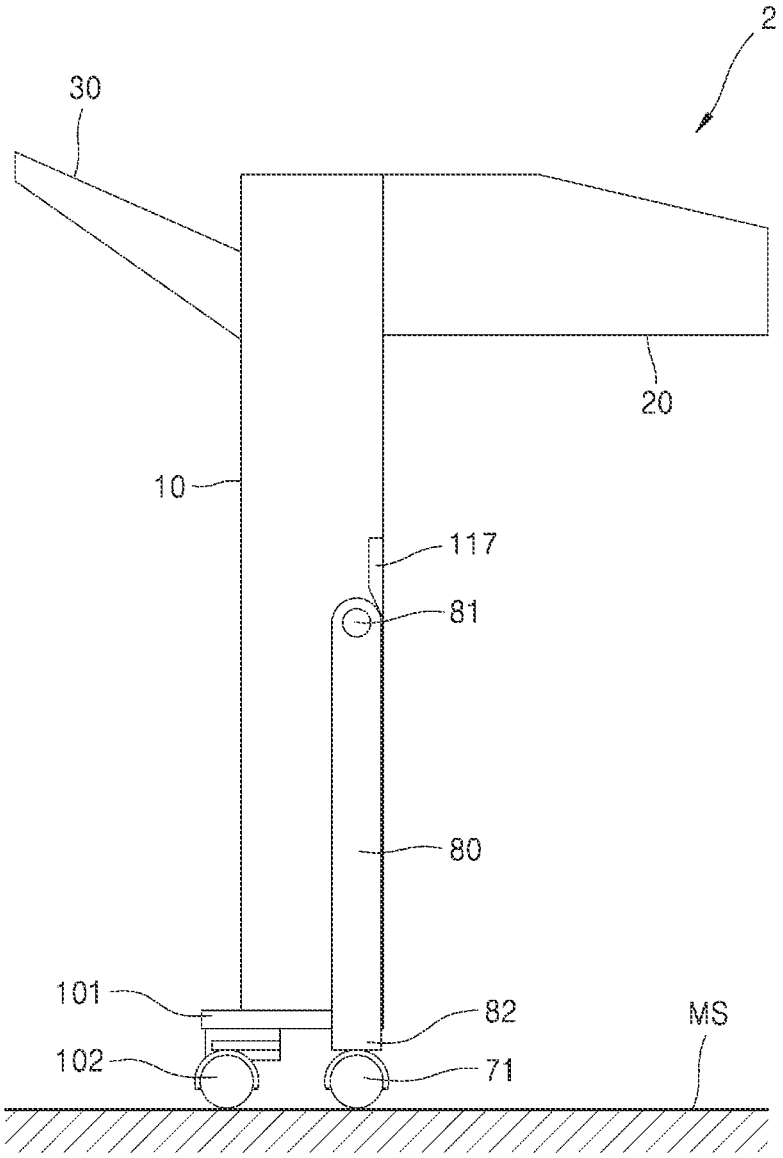
FIG. 18 is a schematic view of a finisher in a state in which an inclination support is located in a storage position according to an example.
Figure 19:
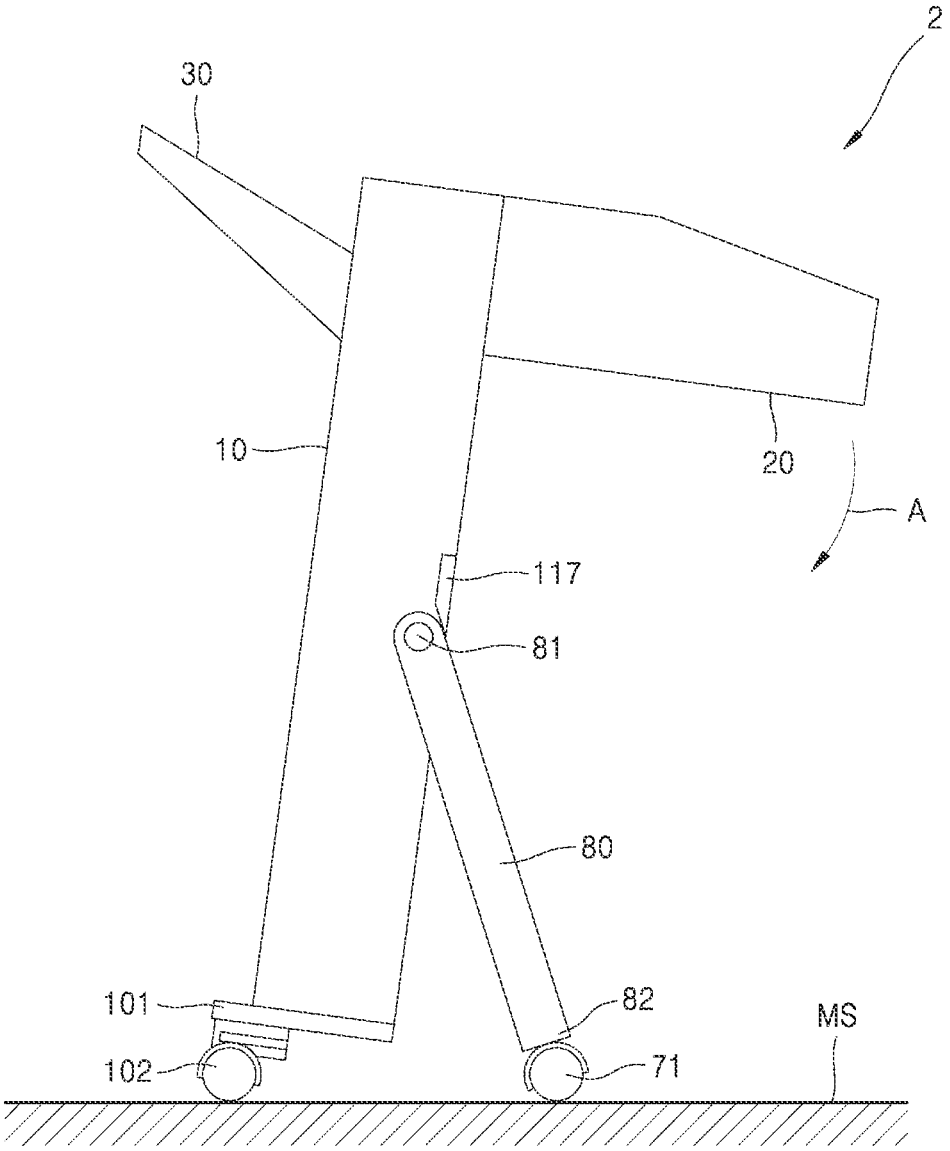
FIG. 19 is a schematic view of a finisher in a state in which an inclination support is located in a support portion according to an example.

FIG. 18 is a schematic view of a finisher in a state in which an inclination support 80 is located in a storage position according to an example. FIG. 19 is a schematic view of a finisher in a state in which the inclination support 80 is located in a support position according to an example. Referring to FIGS. 18 and 19, the fall-over reduction member may include the inclination support 80. The inclination support 80 may include one end 81 rotatably connected to the first portion 10 and another end 82 connected with the second support portion 71. The inclination support 80 may be rotated around the one end 81 between a storage position (FIG. 18) in which the inclination support 80 is stored in the first portion 10 in the vertical direction and a support position (FIG. 19) in which the second support portion 71 is supported on the installation surface MS below the second portion 20.

In a state in which the second support portion 71 is located in the storage position, as shown in FIG. 18, the second support 71 may be located adjacent to the first support portion 102. In this state, the finisher 2 may be combined with the printing device 1. Before the finisher 2 is combined with the printing device 1 or after the finisher 2 is detached from the printing device 1, the inclination support 80 may be rotated around the one end 81 and may be changed into the support position. As shown in FIG. 19, the second support portion 71 may be spaced apart from the first support portion 102 in the lateral direction and may be located below the second portion 20. A stopper 117 may be provided on the first portion 10 and may be in contact with the inclination support 80 located in the support position. The inclination support 80 may not be rotated beyond the support position due to the stopper 117. The finisher 2 may be slightly inclined in a direction of arrow A of FIG. 19, and the second support portion 71 may be supported on the installation surface MS. Thus, the finisher 2 may reduce an occurrence of falling over.

Although not shown, the inclination support 80 may be maintained in the storage position and the support position due to an elastic force of a toggle spring (not shown). When the inclination support 80 is rotated from the storage position to the support position, the direction of the elastic force of the toggle spring may be changed from a direction in which the inclination support 80 is maintained in the storage position, to a direction in which the inclination support 80 is rotated to the support position. When the inclination support 80 reaches the support position, the inclination support 80 may be maintained in the support position due to the elastic force of the toggle spring. When the inclination support 80 is rotated from the support position to the storage position, the direction of the elastic force of the toggle spring may be changed from a direction in which the inclination support 80 is maintained in the support position, to a direction in which the inclination support 80 is rotated in the storage position. When the inclination support 80 reaches the storage position, the inclination support 80 may be maintained in the storage position due to the elastic force of the toggle spring.

The inclination support 80 may be detached from the first portion 10. For example, the inclination support 80 may be detached from the first portion 10, and the finisher 2 may be combined with the printing device 1. After the finisher 2 is detached from the printing device 1, the one end 81 of the inclination support 80 may be combined with the first portion 10 and may be located in the support position.

Figure 20:
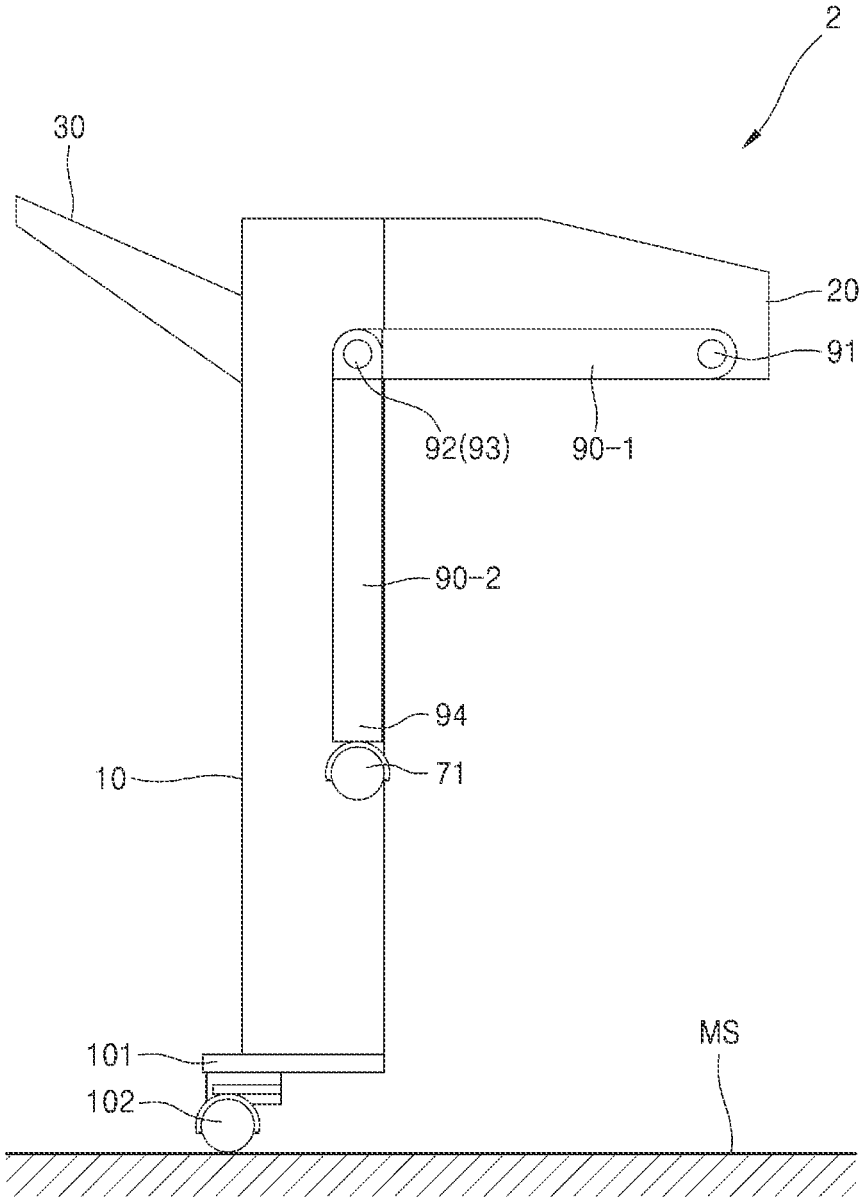
FIG. 20 is a schematic view of a finisher in a state in which a first support is located in a storage position according to an example.
Figure 21:
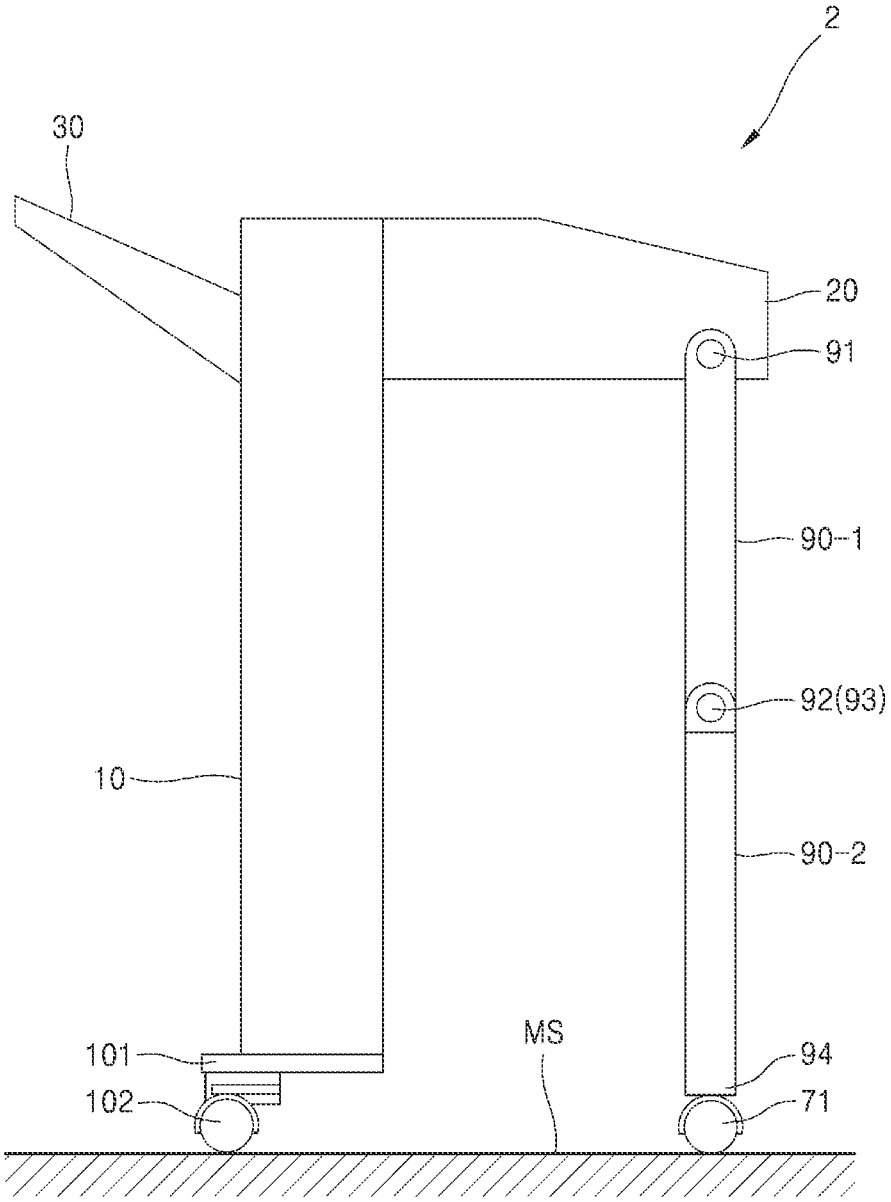
FIG. 21 is a schematic view of a finisher in a state in which a first support is located in a support position according to an example.

FIG. 20 is a schematic view of the finisher 2 in a state in which a first support 90-1 is located in a storage position according to an example. FIG. 21 is a schematic view of the finisher 2 in a state in which the first support 90-1 is located in the support position according to an example.

Referring to FIGS. 20 and 21, the fall-over reduction member may include the first support 90-1 and a second support 90-2. The first support 90-1 may be supported by the second portion 20 to be rotatable between the storage position in which the first support 90-1 is stored in the second portion 20, and the support position in which the first support 90-1 extends from the second portion 20 downward. One end 93 of the second support 90-2 may be rotatably connected to the first support 90-1. A second support portion 71 may be provided on another end 94 of the second support 90-2. When the first support 90-1 is located in the support position, the second support position 71 may be supported on the installation surface MS and may support a load of the second portion 20, and when the first support 90-1 is located in the storage position, the second support 90-2 may be stored in the first portion 10.

In an example, one end 91 of the first support 90-1 may be rotatably supported on the lower portion of the second portion 20. The one end 93 of the second support 90-2 may be rotatably connected to another end 92 of the first support 90-1. A first stopper (not shown) may be provided on the second portion 20 in such a way that the first support 90-1 may not be rotated beyond the support position. A second stopper (not shown) may be provided on the other end 92 of the first support 90-1 or the one end 93 of the second support 90-2 and may maintain the second support 90-2 in an unfolded state.

As shown in FIG. 20, when the first support 90-1 is located in the storage position, the second support 90-2 may be stored in the first portion 10. In this state, the finisher 2 may be combined with the printing device 1. After the finisher 2 is detached from the printing device 1, the first support 90-1 may be rotated around the one end 91 so that the first support 90-1 may be changed into the support position, as shown in FIG. 21. The second support 90-2 may be unfolded in the length direction of the first support 90-1. The second support portion 71 may be spaced apart from the first support portion 102 in the lateral direction and may be supported on the installation surface MS below the second portion 20. Thus, the finisher 2 may reduce an occurrence of falling over.

Although not shown, the first support 90-1 may be maintained in the storage position and the support position due to the elastic force of a first toggle spring (not shown). When the first support 90-1 is rotated between the storage position and the support position, the direction of the elastic force of the toggle spring may be changed from a direction in which the first support 90-1 is maintained in the storage position, into a direction in which the first support 90-1 is rotated in the support position. When the first support 90-1 reaches the support position, the first support 90-1 may be maintained in the support position due to the elastic force of the toggle spring. When the first support 90-1 is rotated from the support position to the storage position, the direction of the elastic force of the toggle spring may be changed from a direction in which the first support 90-1 is maintained in the support position, into a direction in which the first support 90-1 is rotated in the storage position. When the first support 90-1 reaches the storage position, the first support 90-1 may be maintained in the storage position due to the elastic force of the toggle spring. Similarly, the second support 90-2 may be maintained in a position in which the second support 90-2 is stored in the first portion 10, and in an unfolded position due to the elastic force of a second toggle spring. The first support 90-1 may also be detached from the second portion 20 together with the second support 90-2. For example, the first support 90-1 may be detached from the second portion 20 together with the second support 90-2 and the finisher 2 may be combined with the printing device 1. After the finisher 2 is detached from the printing device 1, the one end 91 of the first support 90-1 may be combined with the second portion 20 and may also be located in the support position.

It should be understood that examples described herein should be considered in a descriptive sense and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. A finisher comprising:

a first portion to extend in a vertical direction;

a second portion, extending from the first portion in a lateral direction, comprising an entrance to receive paper as a finishing process target and a finishing unit to perform a finishing process;

a fall-over reduction member to support a load of the second portion;

a stacker to receive paper discharged from the finishing unit and which extends in an opposite direction to the second portion based on the first portion; and an elevation driving unit provided in the first portion to elevate the stacker in the vertical direction.

2. The finisher of claim 1, wherein the elevation driving unit comprises:

a circulating member to connect with the stacker and to circulate in the vertical direction; and a driving motor to drive the circulating member.

3. The finisher of claim 1, wherein the second portion comprises a second stacker provided on an upper portion of the entrance and on which paper on which the finishing process is not performed is to be loaded.

4. The finisher of claim 1, wherein the second portion is mounted between a printing unit and a scanner unit of a printing device.

5. A finisher comprising:

first portion extending in a vertical direction;

a second portion, extending from the first portion in a lateral direction, comprising a finishing unit to perform a finishing process;

a stacker to receive paper discharged from the finishing unit and which extends in an opposite direction to the second portion in the lateral direction based on the first portion; and a height adjustment unit to adjust a height of the second portion from an installation surface.

6. The finisher of claim 5, wherein the height adjustment unit comprises a height adjustment member removably combined with a bottom end of the first portion.

7. The finisher of claim 5, wherein the first portion comprises a third portion to support the second portion and the stacker, and wherein the height adjustment unit includes a fourth portion that is selectively combinable in a plurality of positions with a bottom end of the third portion in the vertical direction.

8. The finisher of claim 5, wherein the first portion comprises a third portion to support the second portion and the stacker, and a fourth portion located at a bottom end of the third portion, and wherein the height adjustment unit comprises a spacer between the third portion and the fourth portion, the spacer being replaceable.

9. A finisher comprising:

a first portion extending in a vertical direction and comprising a first support portion to be supported on an installation surface;

a second portion extending from the first portion in a lateral direction and comprising a finishing unit to perform a finishing process;

a stacker to receive paper discharged from the finishing unit and which extends in an opposite direction to the second portion based on the first portion; and a fall-over reduction member to support a load of the second portion.

10. The finisher of claim 9, wherein the fall-over reduction member comprises a bottom end support extending from a bottom end of the first portion in the lateral direction below the second portion and comprising the second support portion.

11. The finisher of claim 10, wherein the bottom end support is supported by the first portion to be movable in a width direction.

12. The finisher of claim 10, wherein the bottom end support is rotatably supported by the first portion between a first position extending outward in a width direction of the paper and a second position closing inward in the width direction, and wherein the bottom end support comprises a first elastic member to apply an elastic force to the bottom end support in a direction of the first position.

13. The finisher of claim 10, further comprising:

a rotation support installed on the bottom end support to be rotatable between an extending position extending outward in a width direction of the paper and a reduced position closing inward in the width direction; and a second elastic member to apply an elastic force to the rotation support in a direction of the extending position.

14. The finisher of claim 9, wherein the fall-over reduction member comprises a second support portion to be supported on the installation surface below the second portion and an inclination support having one end rotatably connected to the first portion and another end in which the second support portion is provided, the inclination support to be rotated around the one end between a storage position in which the inclination support is stored in the first portion in the vertical direction, and a support position in which the second support portion is supported on the installation surface below the second portion.

15. The finisher of claim 9, wherein the fall-over reduction member comprises:

a second support portion to be supported on the installation surface below the second portion;

a first support supported by the second portion to be rotatable between a storage position in which the first support is stored in the second portion in the lateral direction, and a support position in which the first support extends from the second portion downward; and a second support having one end rotatably connected to the first support and another end in which the second support portion is provided, wherein, when the first support is located in the support position, the second support portion is supported on the installation surface and the second support supports a load of the second portion, and when the first support is located in the storage position, the second support is stored in the first portion.

* * * * *